US007857667B1

(12) United States Patent
Wang

(10) Patent No.: US 7,857,667 B1
(45) Date of Patent: Dec. 28, 2010

(54) SPRING ASSEMBLY WITH SPRING MEMBERS BIASING AND CAPACITIVELY COUPLING JACK CONTACTS

(75) Inventor: Hua Wang, Bothell, WA (US)

(73) Assignee: Leviton Manufacturing Co., Inc., Melville, NY (US)

( * ) Notice: Subject to any disclaimer, the term of this patent is extended or adjusted under 35 U.S.C. 154(b) by 0 days.

(21) Appl. No.: 12/622,365

(22) Filed: Nov. 19, 2009

(51) Int. Cl.
*H01R 24/00* (2006.01)

(52) U.S. Cl. ..... 439/676

(58) Field of Classification Search ..... 439/676, 439/839, 941, 592
See application file for complete search history.

(56) References Cited

U.S. PATENT DOCUMENTS 6,530,810 B2 * 3/2003 Goodrich et al. ..... 439/676
6,579,128 B1 * 6/2003 Wu ..... 439/676
6,641,443 B1 11/2003 Itano et al.
6,786,776 B2 * 9/2004 Itano et al. ..... 439/676
7,037,140 B2 * 5/2006 Aekins et al. ..... 439/676
7,601,034 B1 * 10/2009 Aekins et al. ..... 439/676
7,682,203 B1 * 3/2010 Pharney et al. ..... 439/676
RE41,250 E * 4/2010 Henneberger ..... 439/676

* cited by examiner

*Primary Examiner*—Chandrika Prasad
(74) *Attorney, Agent, or Firm*—Davis Wright Tremaine LLP; George C. Rondeau, Jr.; Heather M. Colburn

(57) ABSTRACT

A spring assembly for a communications jack configured to receive a communications plug having a plurality of plug contacts. The jack includes first, second, third, and fourth jack contacts. The first and second jack contacts are configured to carry a first differential signal. The third and fourth jack contacts are configured to carry a second differential signal. Each jack contact is electrically connected to a corresponding one of the plug contacts when the plug is received by the jack. The spring assembly has a conductive spring member for each jack contact. Each spring member is electrically connected to a corresponding jack contact and biases that jack contact against a corresponding plug contact. To reduce crosstalk, the spring member connected to the first jack contact is capacitively coupled to the third jack contact and the spring member connected to the fourth jack contact is capacitively coupled to the second jack contact.

25 Claims, 15 Drawing Sheets

SPRING ASSEMBLY WITH SPRING MEMBERS BIASING AND CAPACITIVELY COUPLING JACK CONTACTS

BACKGROUND OF THE INVENTION

1. Field of the Invention

The present invention is directed generally to communication jacks.

2. Description of the Related Art

Communication jacks incorporating Retention Force Technology ("RFT") are commercially available from Leviton Manufacturing Co., Inc. and described in U.S. Pat. Nos. 6,786,776 and 6,641,443, which are incorporated by reference herein in their entireties. For illustrative purposes, FIGS. 4 and 2 of these patents have been reproduced herein as FIGS. 1 and 2, respectively.

Turning to FIG. 1, the aforementioned patents describe an electrical connector jack 10 that includes a dielectric housing or body 12 and a plurality of resilient contact tines 14 (see FIG. 2) arranged in a parallel arrangement within an interior receptacle 16 of the body. When a conventional plug 18 having a plurality of metal conductive plates or contacts 20 is inserted into the receptacle 16, the contacts 20 are in contact with corresponding ones of the tines 14. The tines 14 each have a first end portion 22 fixedly attached to a printed circuit board ("PCB") 24, and a second free end portion 26 opposite the first end portion 22. Between the first and second end portions 22 and 26, the tines each include a first contact portion 28 and a second contact portion 47. The first contact portions 28 are arranged in the body 12 to be contacted by the contacts 20 of the plug 18 when the plug is inserted into the receptacle 16. The second contact portions 47 are located between the first contact portions 28 and the first end portions 22.

When the plug contacts 20 contact the first contact portions 28 of the tines 14, the contacted tines are moved by the plug contacts 20 in a generally downward direction, with a small rearward component, as the tines flex downward in response thereto. Each of the tines 14 is sufficiently resilient to produce a first generally upward force against the corresponding plug contact 20 in response thereto. This serves as a contact force between the tine 44 and the plug contact 20 to help provide good electrical contact.

A spring assembly 32 is mounted to the PCB 24 in a position below the tines 14. As best seen in FIG. 2, the spring assembly 32 has a pair of protrusions 34 which are inserted into apertures in the PCB 24. The spring assembly 32 includes eight resilient, non-conductive spring arms 44, each positioned immediately under a correspondingly positioned one of the tines 14. A head portion 45 of each spring arm 44 is in contact with an underside of the second contact portion 47 of the tine, the underside being opposite the side of the tine contacted by the plug contact 20. Each of the spring arms 44 is positioned to have the head portion 45 thereof engaged by and move downward with the correspondingly positioned tine 14 as the tine moves downward when the plug 18 is inserted into the receptacle 16.

Each of the spring arms 44 is independently movable relative to the other ones of the spring arms, and each spring arm provides a second generally upward force on the correspondingly positioned tine which is transmitted to the plug contact 20 contacting the tine. This creates a supplemental contact force that causes an increased contact force between the tine 14 and the plug contact 20. For the sake of brevity, the benefits of the structures of the jack 10 that are described in U.S. Pat. Nos. 6,786,776 and 6,641,443 are not repeated herein.

While not described in U.S. Pat. Nos. 6,786,776 and 6,641,443, referring to FIG. 3, the performance of the jack 10 may be improved by the addition of crosstalk compensation components. For example, in the drawings, the tines 14 include eight separate spaced apart contacts or tines J-T1 to J-T8 arranged in series. The center-most tines J-T3, J-T4, J-T5, and J-T6 may be connected to a flexible PCB 50 having crosstalk attenuating or cancelling circuits formed thereon configured to provide crosstalk compensation. The flexible PCB 50 may include contacts 52, 54, 56, and 58 configured to be soldered to the centermost tines J-T3, J-T4, J-T5, and J-T6, respectively.

In the embodiment illustrated in FIG. 3, the spring assembly 32 (see FIGS. 1 and 2) is implemented as a non-conductive plastic spring 60 constructed (e.g., molded) as a single piece instead of from two separate components (e.g., the first portion 46*a* and the second portion 46*b* described in U.S. Pat. Nos. 6,786,776 and 6,641,443). However, the spring 60 is configured to function in a manner substantially similar to that of the spring assembly 32 and to provide the supplemental contact forces to the tines 14 that causes an increased contact force between the tines 14 and the plug contacts 20. Thus, the current technology uses a non-conductive plastic spring (e.g., the spring assembly 32 or the spring 60) to help generate sufficient contact force between the tines 14 and the plug contacts 20 (see FIG. 1) and a flexible PCB (e.g., the flexible PCB 50) to provide electrical crosstalk compensation.

The jack 10 (see FIG. 1) may be assembled by first pressing the tines J-T1 to J-T8 into the PCB 24 at appropriate locations within the circuits located on the PCB 24. Then, crosstalk compensation is added to the jack 10 (see FIG. 1), by soldering the contacts 52, 54, 56, and 58 of the flexible PCB 50 to second free end portions 26 of the center-most tines J-T3, J-T4, J-T5, and J-T6. Next, the soldered connections are washed to remove excess solder material (not shown). The non-conductive plastic spring 60 or the spring assembly 32 is connected to the PCB 24 below the tines T1 to J-T8 to provide the supplemental contact forces thereto. The tines J-T1 to J-T8 (and the non-conductive plastic spring 60 or the spring assembly 32) connected to the PCB 24 are inserted into the body 12 (see FIG. 1) and extend forwardly into the receptacle 16. Then, the PCB 24 is affixed to the body 12.

Thus, a need exists for jacks that provide both adequate contact force between the tines and the plug contacts and electrical crosstalk compensation. Improvements in manufacturability of jacks may reduce their cost of assembly and a reduction in the number of components may improve reliability of the jacks. Therefore, a jack that includes fewer components than prior art jacks and is easier to assemble than prior art jacks is desirable. The present application provides these and other advantages as will be apparent from the following detailed description and accompanying figures.

BRIEF DESCRIPTION OF THE SEVERAL VIEWS OF THE DRAWING(S)

DETAILED DESCRIPTION OF THE INVENTION

Figure 2:
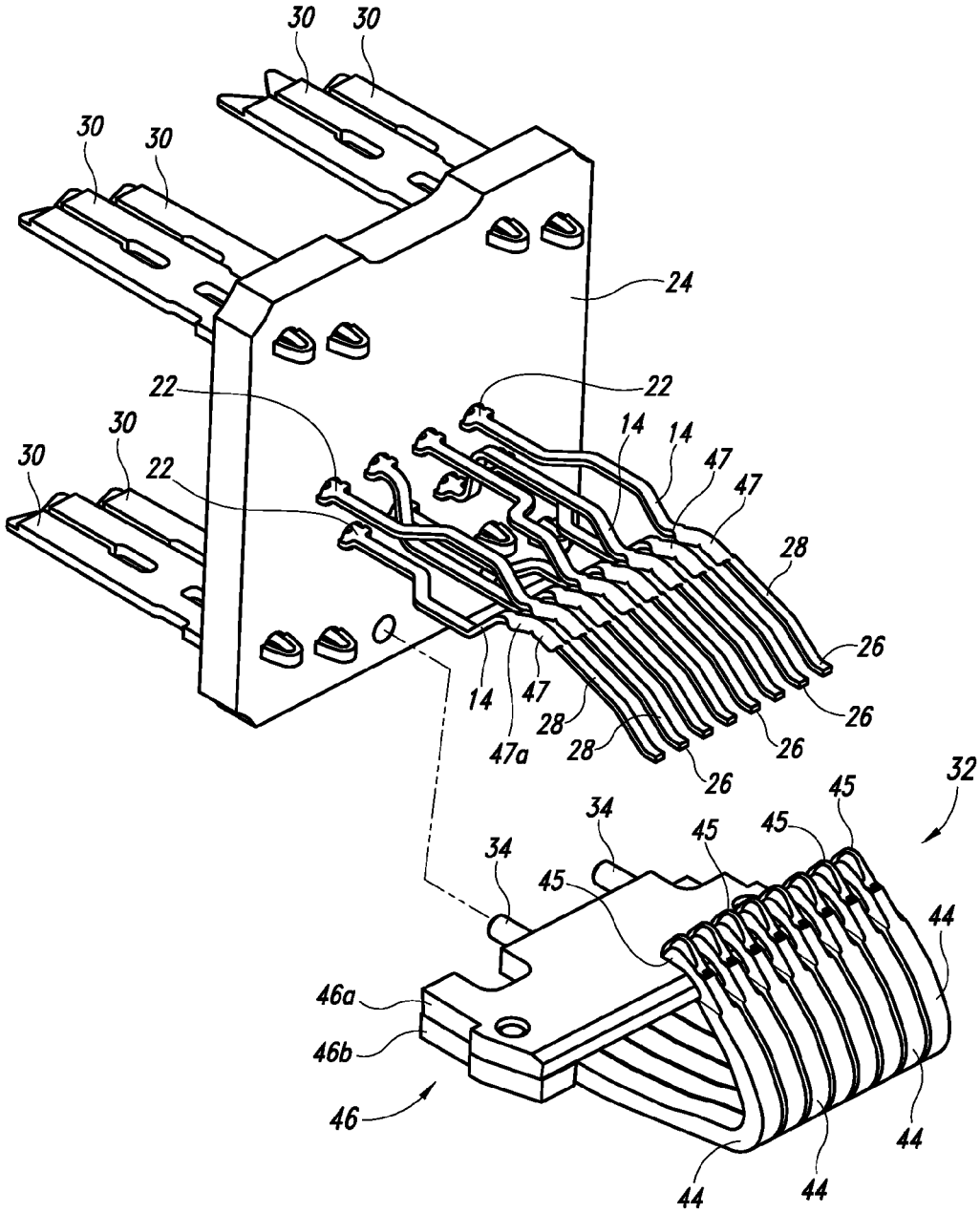
FIG.2 (PRIOR ART)
FIG. 2 is a perspective view of a plurality of tines, a printed circuit board, a plurality of wire contacts, and a spring assembly of the jack of FIG. 1.
Figure 4:
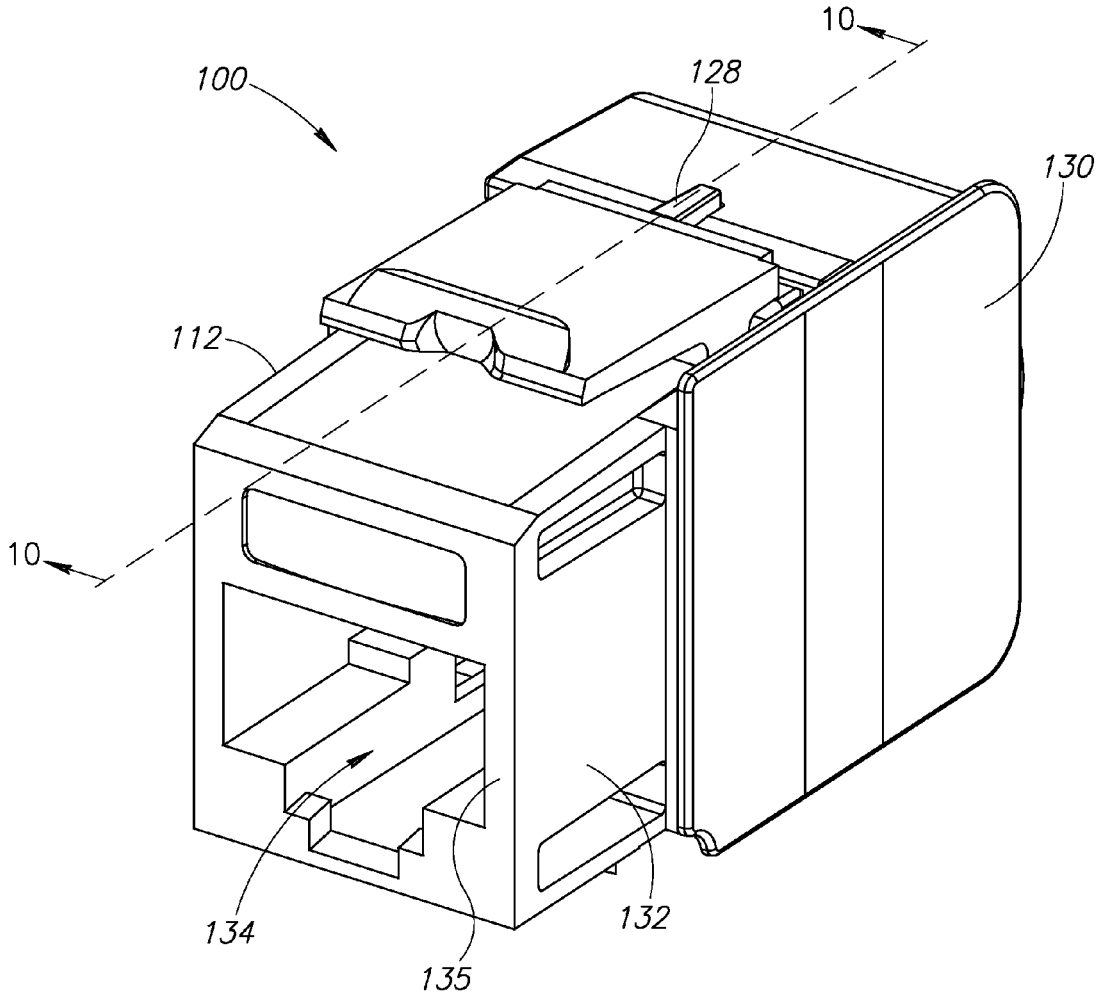
FIG. 4 is a perspective view of a communication jack constructed in accordance with the present invention.

FIG. 4 illustrates a communication jack 100 of a similar construction as shown in FIG. 2. In the embodiment illustrated, the jack 100 has been configured to function as a Category 6 RJ series electrical connector jack. However, this is not a requirement and in alternate embodiments, the jack 100 may be configured in accordance with another style of jack, including but not limited to Category 3, Category 5, Category 5e, and other styles of telecommunication and non-telecommunication jacks.

Figure 5:
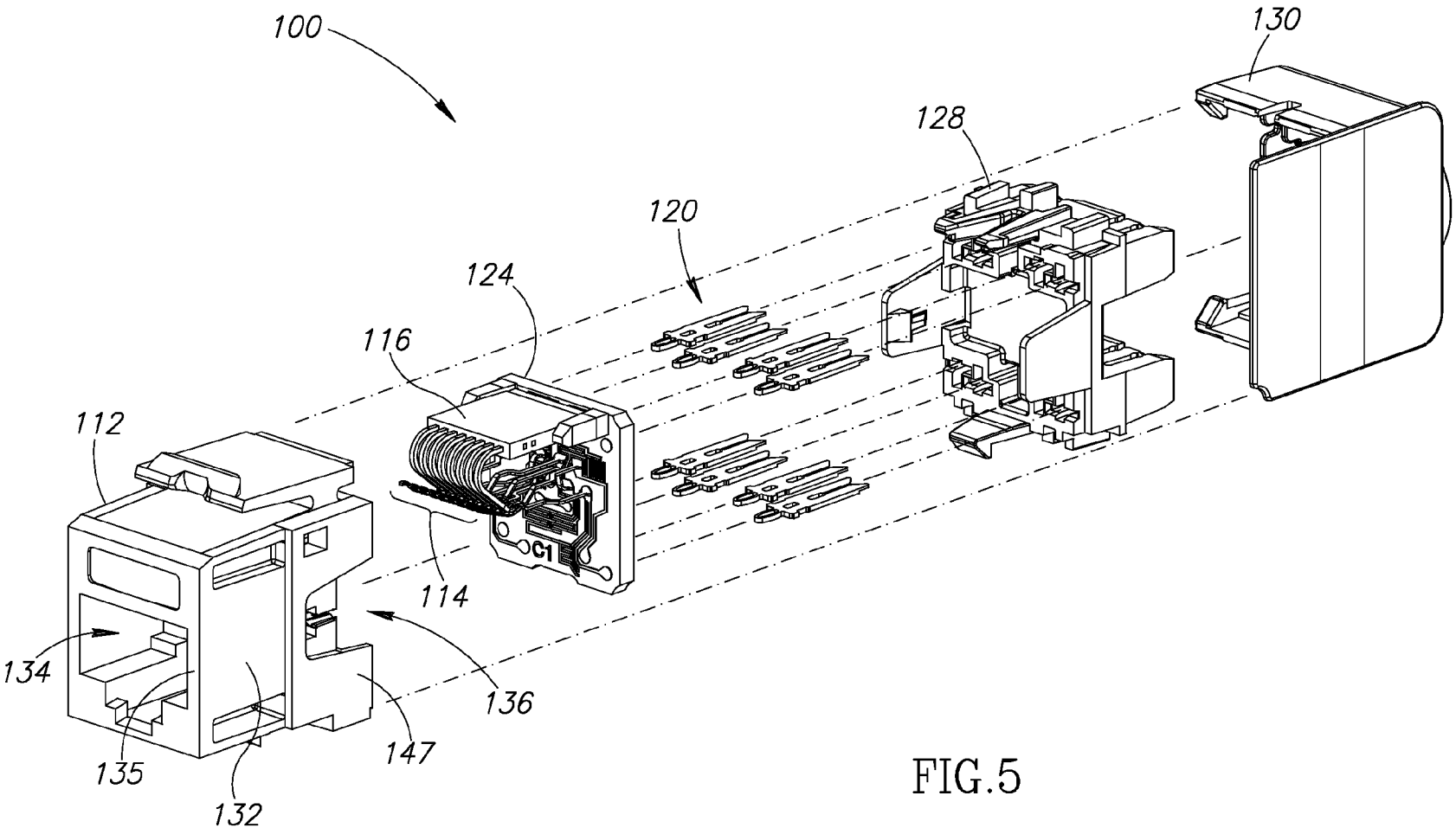
FIG. 5 is a partially exploded perspective view of the jack of FIG. 4.

Referring to FIG. 5, the jack 100 illustrated includes a dielectric housing or body 112, a plurality of resilient contacts or tines 114, a spring assembly 116, a plurality of wire contacts 120, a substrate (depicted as a printed circuit board ("PCB") 124), a carrier or terminal block 128, and an optional shield enclosure 130. Like the prior art jack 10 (illustrated in FIG. 1), the jack 100 is configured for use with the plug 18 (depicted in FIGS. 6 and 10).

Body

The body 112 may be implemented as any body suitable for use in a communication jack. For example, the body 112 may be substantially identical to the body 12 illustrated in FIG. 1 and described in the Background Section. The body 112 includes a sidewall 132 defining an interior receptacle 134. The sidewall 132 includes a frontward opening portion 135 in communication with the interior receptacle 134. As may best be viewed in FIG. 6, which illustrates the backside of the body 112, the sidewall 132 also includes a rearward opening portion 136 opposite the frontward opening portion 135 and in communication with the interior receptacle 134.

Figure 6:
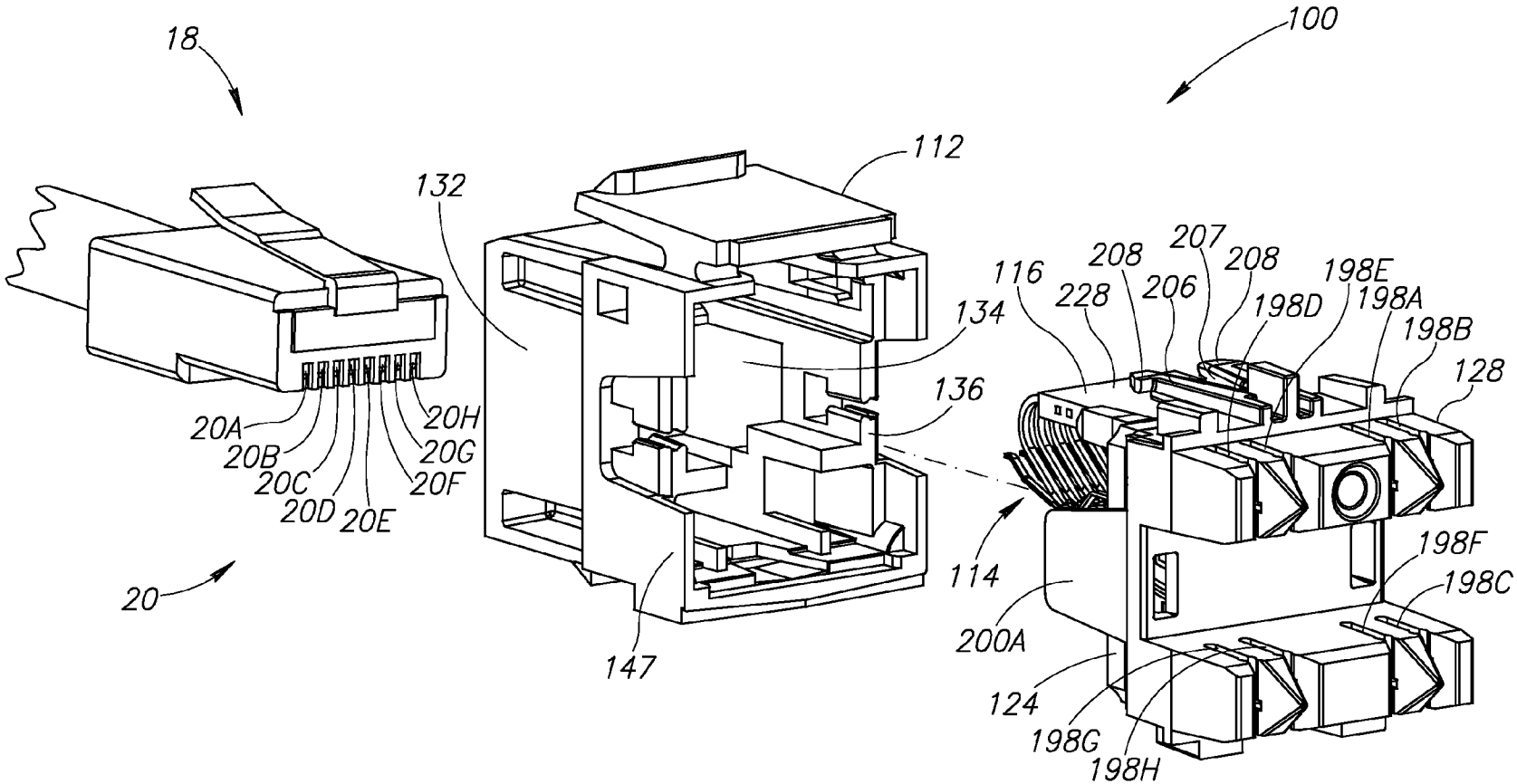
FIG. 6 is a partially exploded perspective view of the jack of FIG. 4 omitting a shield enclosure and illustrated alongside a prior art communication plug.

FIG. 6 also illustrates the plug 18 and its plug contacts 20. In the embodiment illustrated, the plug contacts 20 include eight plug contacts 20A to 20H. However, this is not a requirement. In alternate implementations, a plug having a different number of plug contacts (e.g., 4, 6, 10, 12, 16, etc.) may be used with and inserted inside the jack 100.

Figure 7:
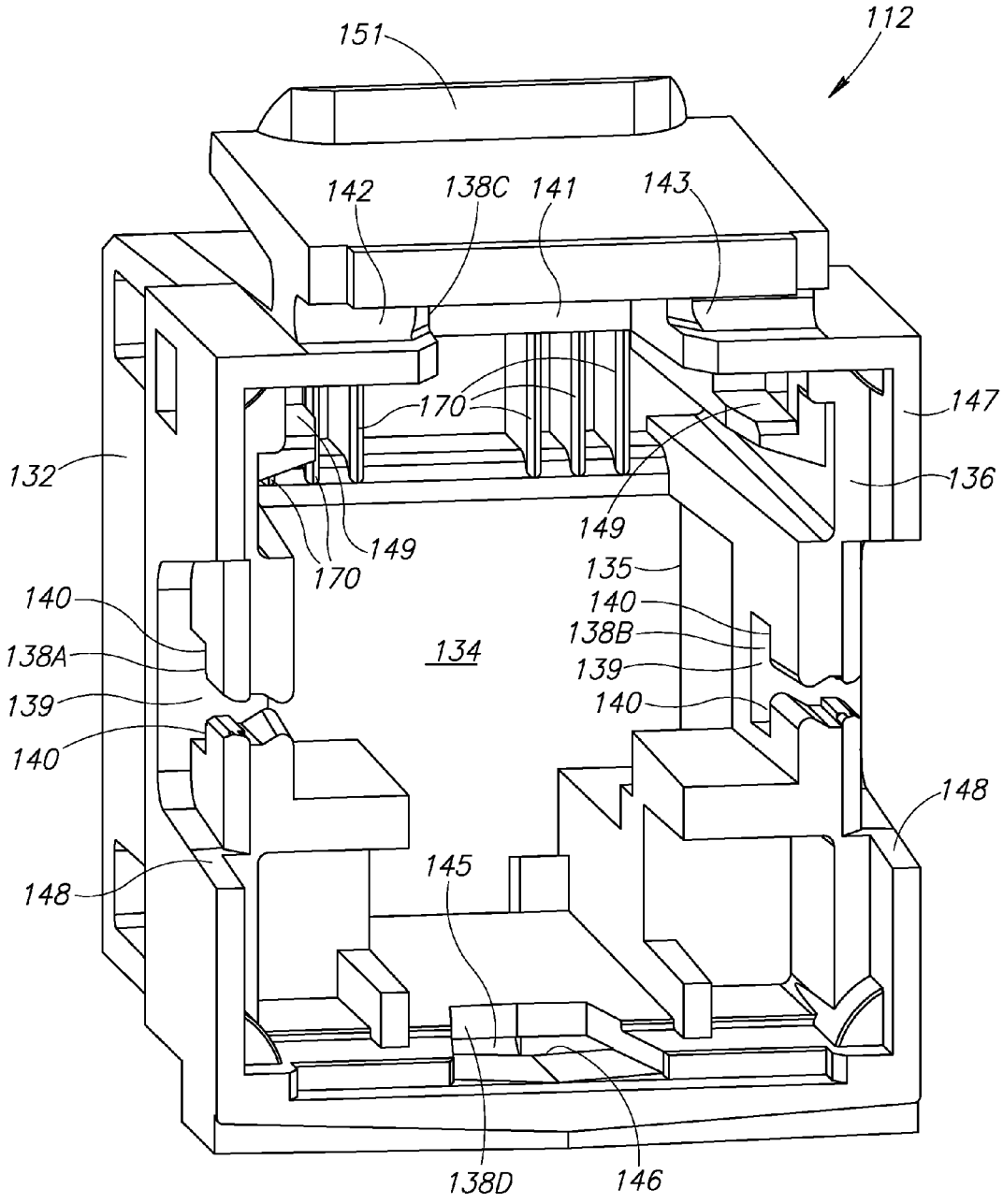
FIG. 7 is a perspective view of the backside of a dielectric outer body of the jack of FIG. 4.

Turning to FIG. 7, which provides an enlarged view of the backside of the body 112, the body 112 also includes one or more connector portions 138A to 138D for attaching the terminal block 128 (see FIG. 6) to the body 112. In the embodiment illustrated, the connector portions 138A to 138D are configured such that the body 112 and the terminal block 128 (see FIG. 6) may be snapped together. In such embodiments, the connector portions 138A to 138D are each configured as a portion of a snap fit connector. The connector portions 138A and 138B are located on opposite sides of the sidewall 132 from one another and each include a recess or an aperture 139 at least partially defined by at least one forward facing surface 140. The connector portions 138C and 138D are located on opposite sides of the sidewall 132 from one another. The connector portion 138C includes a channel 141 defined between a pair of spaced part wall sections 142 and 143 each having a forward facing surface 144 best viewed in FIG. 10. The connector portion 138D includes a recess or an aperture 145 adjacent to a forward facing surface 146 best viewed in FIG. 10.

The body 112 includes a skirt 147 disposed about an outside portion of the sidewall 132 extending rearwardly beyond the rearward opening portion 136 of the sidewall 132. The skirt 147 is configured to receive the PCB 124 (see FIG. 10) and allow the PCB to abut the rearward opening portion 136 of the sidewall 132. In this manner, the PCB 124 (see FIG. 10) closes the rearward opening portion 136 and cuts off access to the interior receptacle 134 through the rearward opening portion 136. Optionally, the skirt 147 includes a cutout portion 148 adjacent each of the connector portions 138A and 138B to allow access thereto. The skirt 147 prevents the PCB 124 (see FIG. 10) from moving laterally relative to the rearward opening portion 136 of the sidewall 132 and thereby helps maintain the PCB 124 in engagement with the rearward opening portion 136 of the sidewall 132. Optionally, the skirt 147 may be configured to receive at least a portion of the terminal block 128 (see FIG. 10). However, this is not a requirement.

In the embodiment illustrated, the body 112 includes dividers 170 configured to fit between adjacent ones of the tines 114A to 114H (see FIG. 11) that help maintain the lateral spacing of the tines and their electrical isolation from one another.

Figure 10:
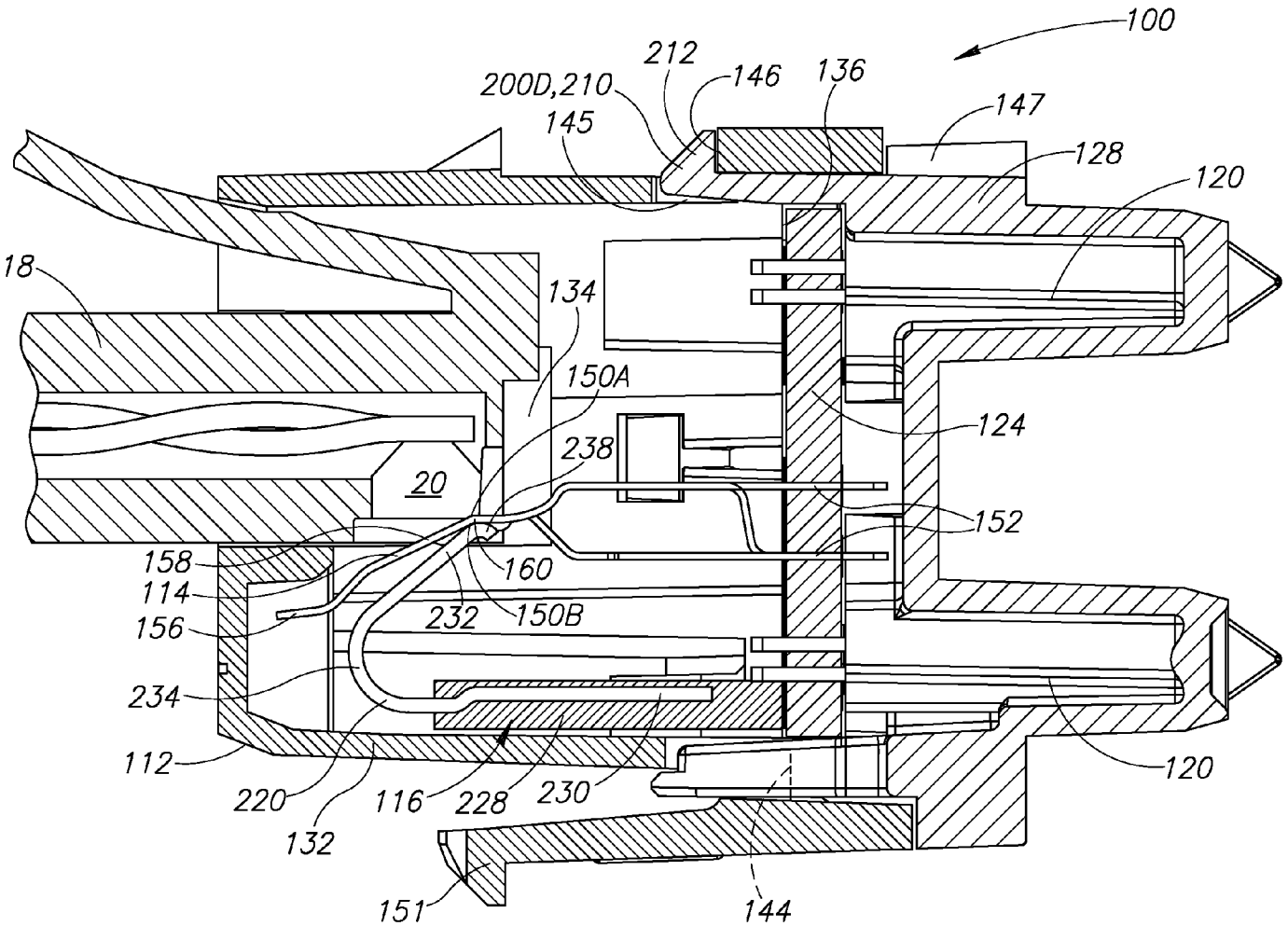
FIG. 10 is a cross-sectional view of the jack taken substantially along line 10-10 of FIG. 4 illustrated with the prior art plug received in the receptacle of the jack and the jack in an orientation that is upside down relative to the orientation of the jack depicted in FIG. 4.

As may be seen in FIG. 10, when the body 112 and the terminal block 128 are coupled together, the PCB 124 is sandwiched therebetween and held in place against the rearward opening portion 136 (see FIG. 7) of the sidewall 132 by the terminal block 128. Returning to FIG. 7, optionally, the body 112 may include recesses or guide rails 149 positioned inside the interior receptacle 134 and accessible via the rearward opening portion 136 of the sidewall 132. The guide rails 149 are configured to guide and/or support the spring assembly 116 (see FIG. 6) inside the interior receptacle 134 relative to the body 112 and the tines 114. Thus, the guide rails 149 position the spring assembly 116 (see FIG. 6) inside the interior receptacle 134 relative to the body 112 and the tines 114

Optionally, the body 112 may include one or more connector portions 151 configured to (removably or permanently) couple the body 112 inside an aperture (not shown) formed in an external structure (not shown). For example, the connector portions 151 may be used to couple the body 112 inside an aperture (not shown) formed in a patch panel, rack, wall outlet, and the like.

Tines

Figure 8:
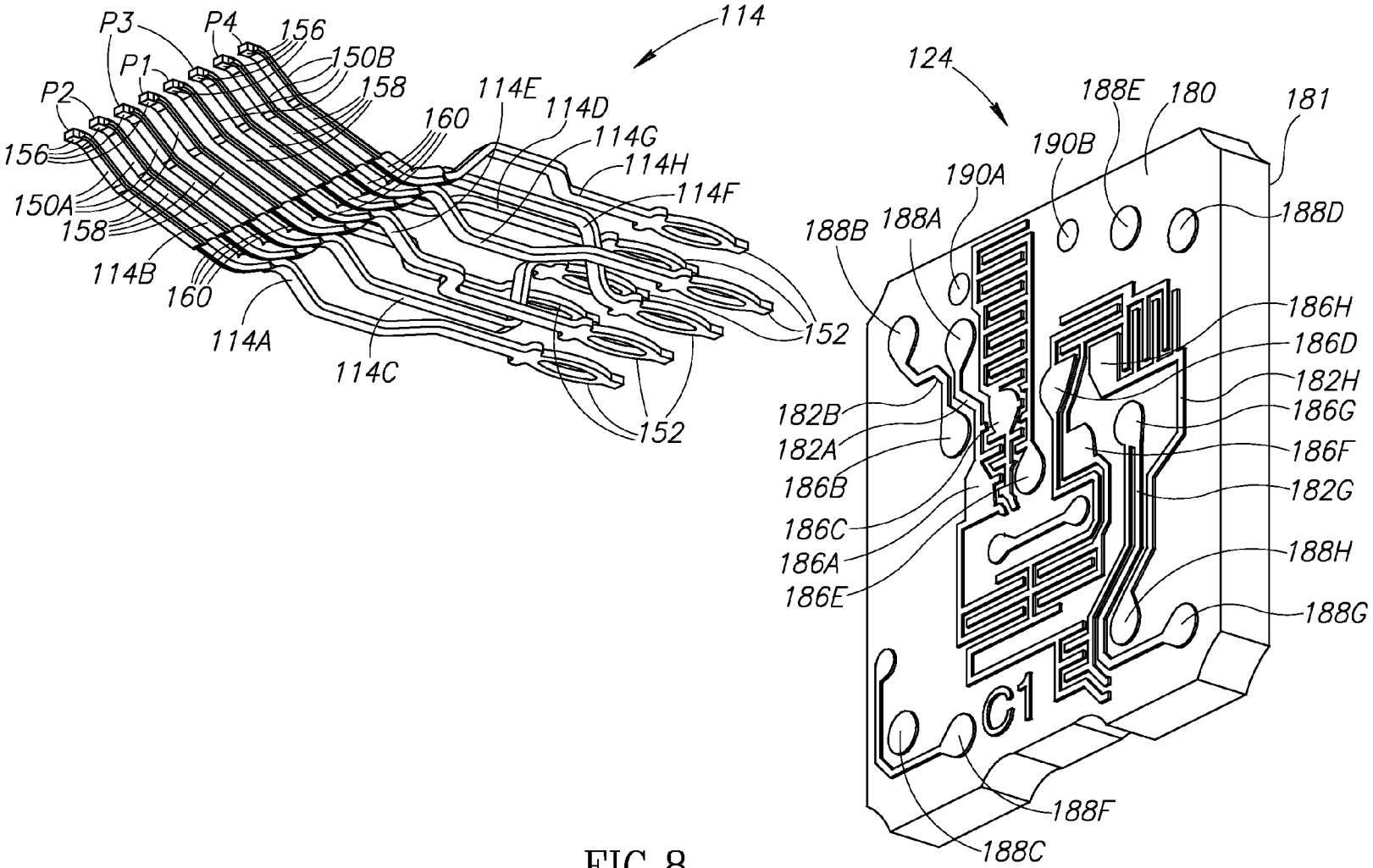
FIG. 8 is a perspective view of the tines and the printed circuit board of the jack of FIG. 4 shown disconnected.

Turning to FIG. 8, in the embodiment illustrated, the tines 114 are substantially identical to the tines 14 (see FIGS. 1-3) described in the Background Section. The jack 100 includes a tine 114 for each of the plug contacts 20 (see FIG. 6). Thus, in the embodiment illustrated, the plurality of tines 114 includes eight individual tines 114A to 114H, which correspond to the eight plug contacts 20A to 20H (see FIG. 6), respectively. Through application of ordinary skill in the art to the present teachings, embodiments including different numbers of tines (e.g., 4, 6, 10, 12, 16, etc.) may be constructed for use with plugs having different numbers of plug contacts.

As is apparent to those of ordinary skill in the art, the tines 114A to 114H are used to transmit differential signals. Thus, the tines 114A to 114H include four differential signal pairs: a first pair "P1" that includes the tines 114D and 114E; a second pair "P2" that includes the tines 114A and 114B; a third or split pair "P3" that includes the tines 114C and 114F; and a fourth pair "P4" that includes the tines 114G and 114H.

Each of the tines 114 has a first side 150A configured for engagement with one of the plug contacts 20 (see FIGS. 6 and 10) and a second side 150B opposite the first side 150A and configured for engagement with the spring assembly 116 (see FIG. 10). Each of the tines 114 has a first end portion 152 configured to be fixedly attached to the PCB 124, and a second free end portion 156 opposite the first end portion 152. Each of the tines 114 also includes a first contact portion 158 and a second contact portion 160 located between the first and second end portions 152 and 156. The first contact portions 158 are in a generally parallel arrangement and are essentially allowed to "float" as simple cantilevered beams.

Figure 1:
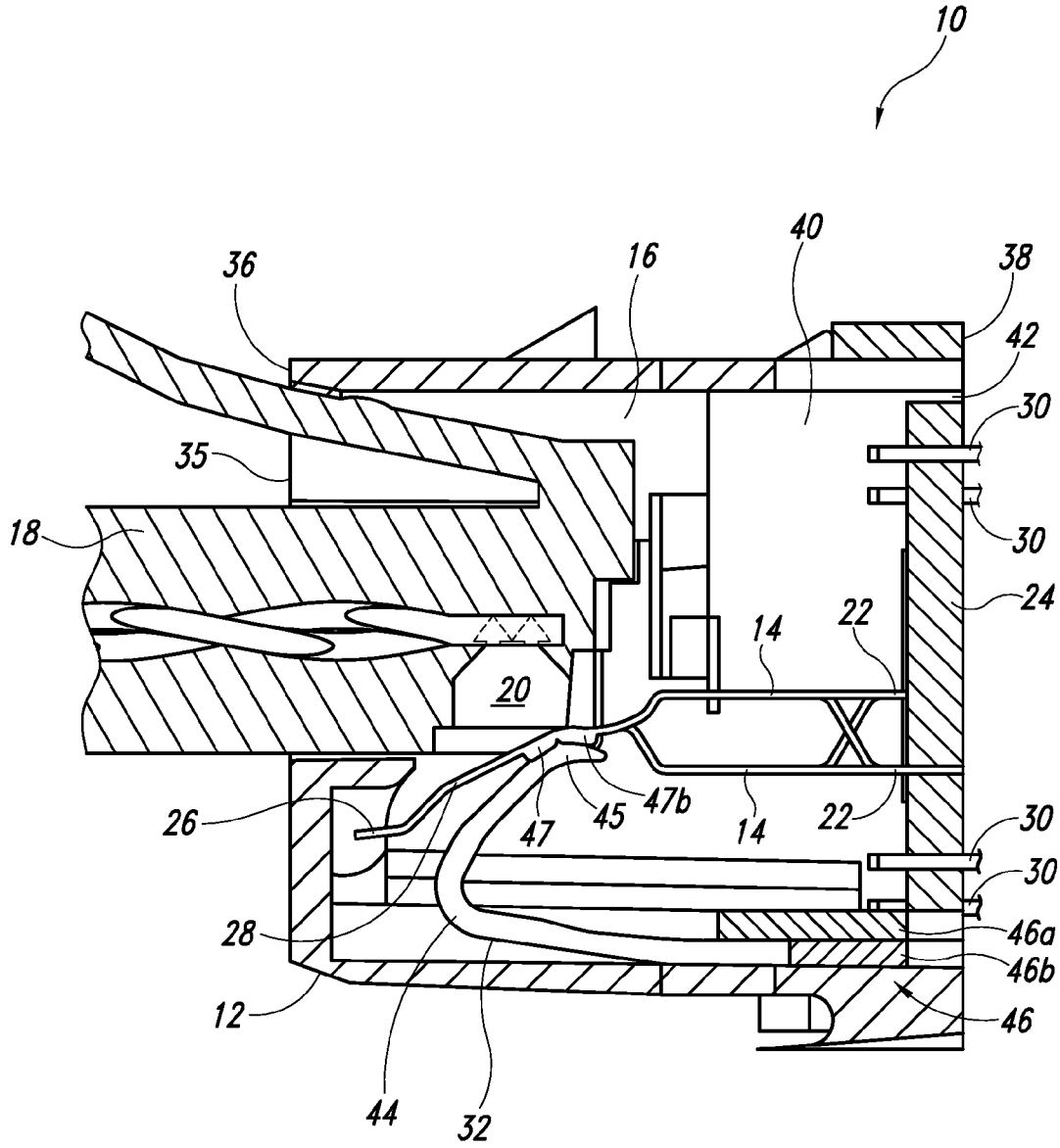
FIG.1 (PRIOR ART)
FIG. 1 is a cross-sectional view of a prior art communication jack.

In FIG. 10, the jack 100 has been illustrated in an upside down orientation relative to the orientation of the jack depicted in FIG. 4 to place the jack 100 in an orientation similar to the orientation of the prior art jack 10 depicted in FIG. 1. Further, the jack 100 has been illustrated with the plug 18 received inside the interior receptacle 134. For illustrative purposes, the optional shield enclosure 130 (see FIGS. 4 and 5) has been omitted from FIG. 10.

The first contact portions 158 are arranged in the body 112 such that the first sides 150A of the tines 114 within the first contact portions are contacted by the plug contacts 20 of the plug 18 when the plug is inserted into the interior receptacle 134. The second contact portions 160 are located between the first contact portions 158 and the first end portions 152. Thus, the second contact portions 160 are forward of the first end portions 152 of the tines 114 and rearward of the first contact portions 158.

As illustrated in FIG. 10, the tines 114 are coupled to the PCB 124 by their first end portions 152 such that they extend into the interior receptacle 134. As mentioned above, within the interior receptacle 134, the tines 114 are arranged in a parallel arrangement to engage the plug contacts 20. The tines 114 are positioned such that their the first sides 150A within the first contact portions 158 are contacted by the contacts 20 of the plug 18 when the plug 18 is inserted into the interior receptacle 134 and make electrical contact therewith.

Figure 9:
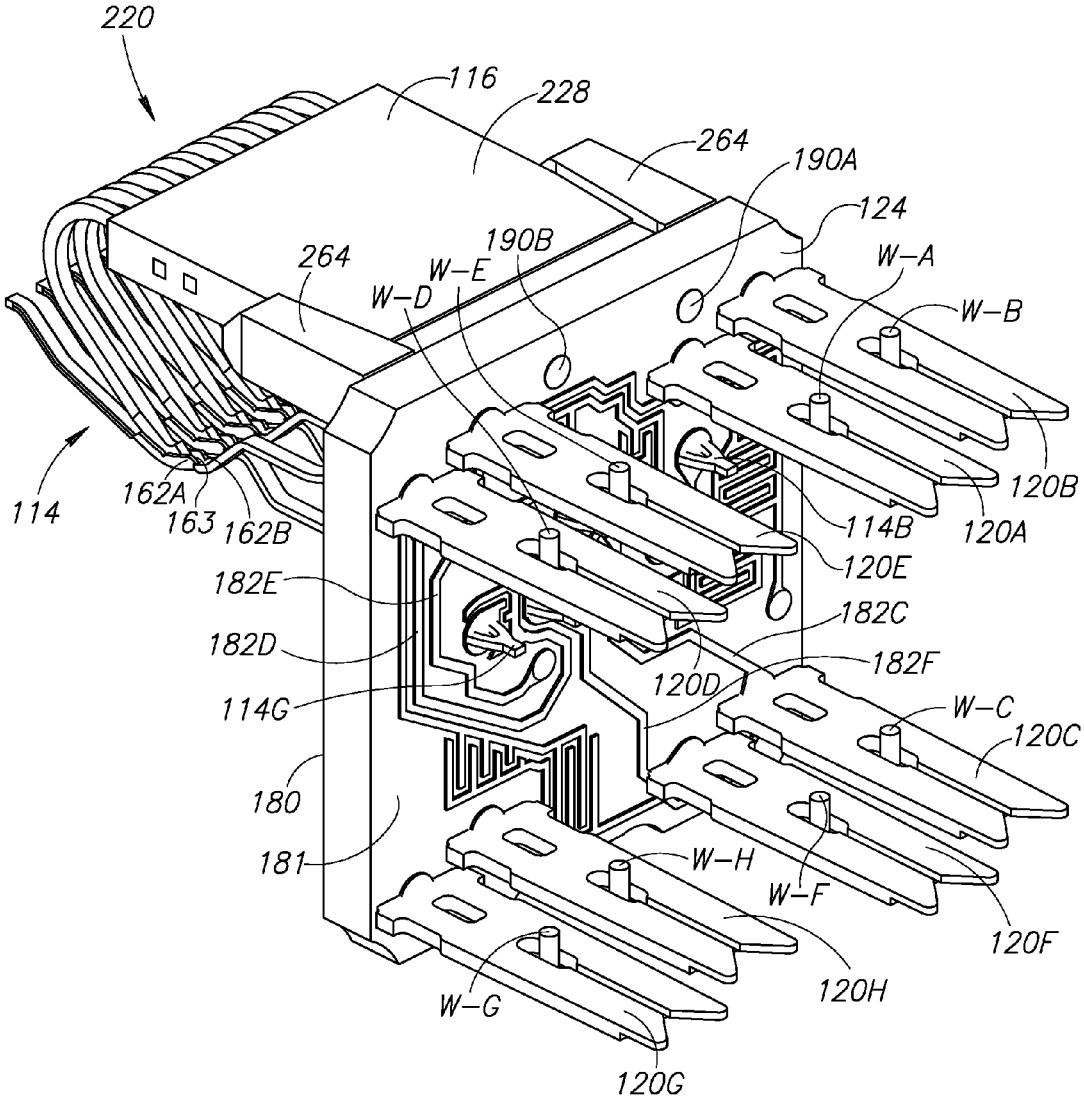
FIG. 9 is a perspective view of the backside of the printed circuit board with a plurality of tines, a spring assembly, and a plurality of wire connectors connected thereto.
Figure 11:
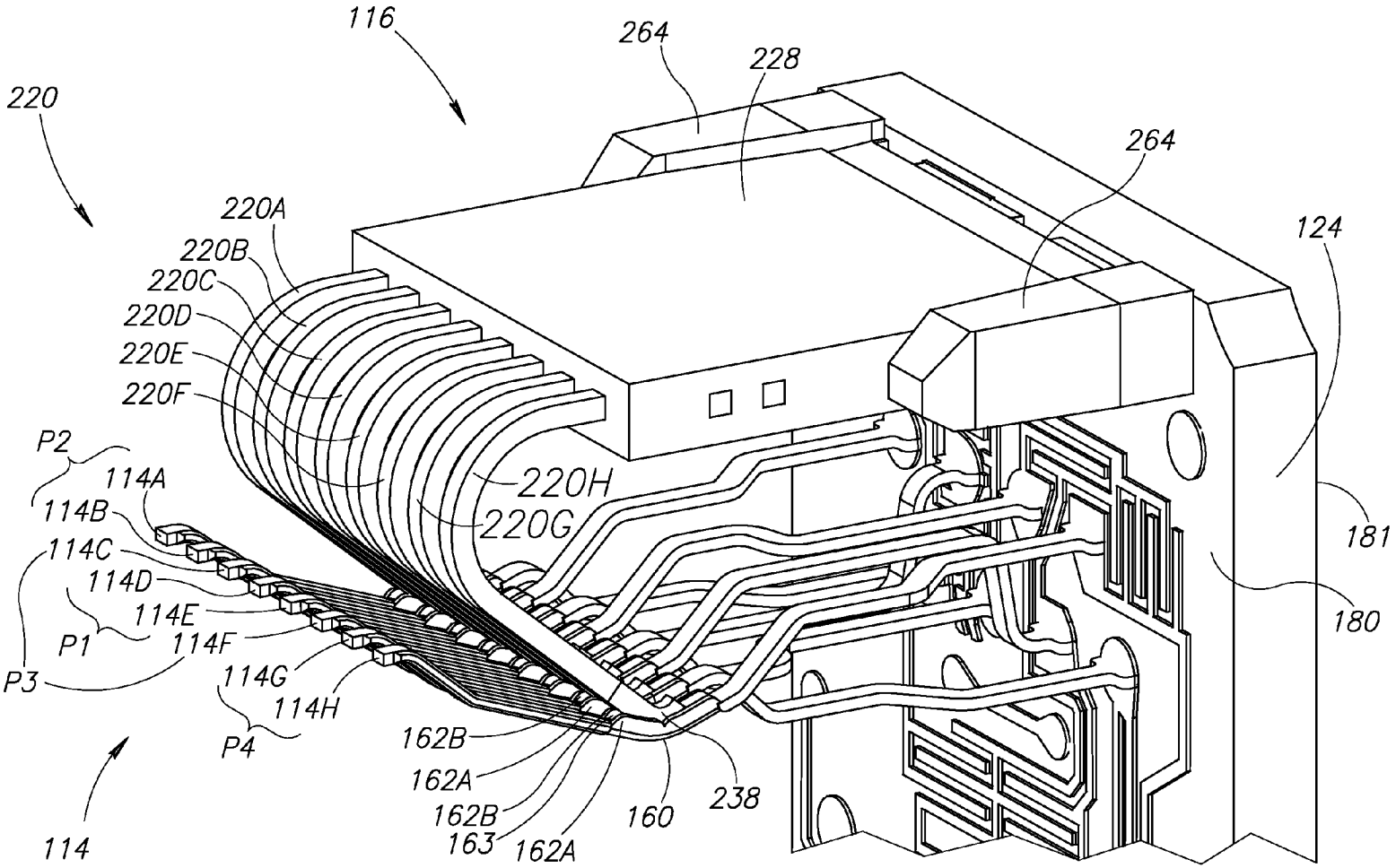
FIG. 11 is a perspective view of the front side of the printed circuit board of FIG. 8 with the plurality of tines and the spring assembly connected thereto.

The second contact portions 160 of the tines 114 are configured such that the second sides 150B of the tines within the second contact portions 160 are engaged by the spring assembly 116. Turning to FIGS. 9 and 11, in the embodiment illustrated, the second contact portions 160 each include a first side rail 162A spaced apart laterally from a second side rail 162B. In each of the second contact portions 160, the first and second side rails 162A and 162B extend in a substantially parallel manner along a portion the tine 114 to define a longitudinally extending channel 163 therebetween.

The tines 114A to 114H are laterally spaced apart from one another so that the first contact portions 158 of each tine is contacted by a correspondingly positioned one of the plug contacts 20A to 20H (see FIG. 6) when the plug 18 is inserted into the interior receptacle 134. When the plug contacts 20A to 20H press against the contacted tines 114A to 114H, respectively, the contacted tines deflect in a generally outward direction, with a small rearward component, in response to the inwardly directed force. In other words, the tines 114A to 114H flex outwardly in response to having been contacted by the plug contacts 20A to 20H, respectively.

Each of the tines 114A to 114H is sufficiently resilient to produce a first generally inward force, with an optional forward component, in opposition to the outward force applied by the corresponding one of the plug contact 20A to 20H, respectively. The opposing forces of the plug contacts 20 and the tines 114 provide a contact force between the tine 114 and the plug contact 20 that helps provide good electrical contact therebetween. Depending upon the implementation details, it may be desirable to keep the tines 114 as short as possible to improve electrical performance of the jack, while still providing sufficient resiliency to accommodate legacy plugs and contact force needed to meet FCC standards.

Wire Contacts

Figure 12:
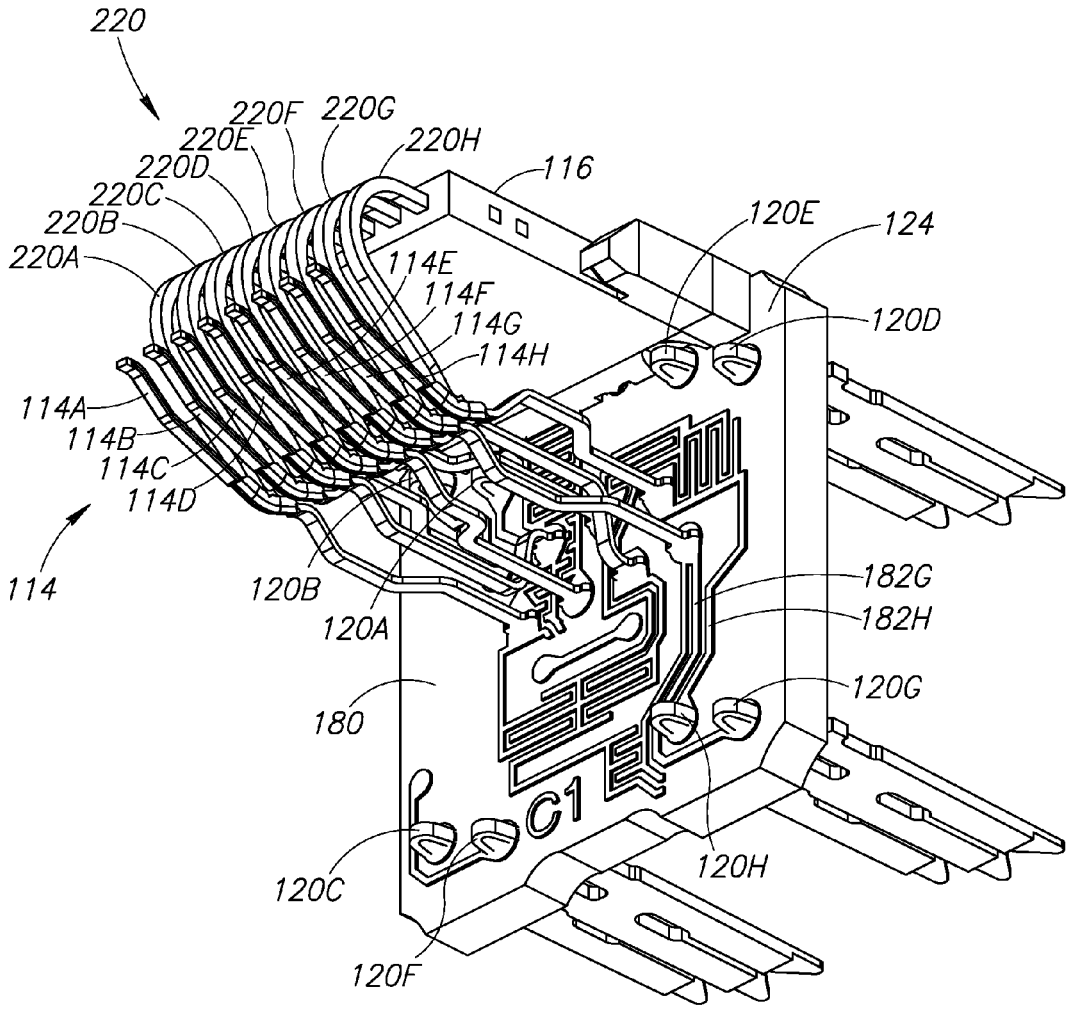
FIG. 12 is another perspective view of the front side of the printed circuit board of FIG. 11 with the plurality of tines, the spring assembly, and the plurality of wire connectors connected thereto.

As illustrated in FIGS. 5 and 12, each of the wire contacts 120 may be implemented as an insulation displacement connector ("IDC"). However, this is not a requirement and embodiments in which the wire contacts 120 are implemented in another manner are also within the scope of the present teachings. Turning to FIG. 12, the jack 100 includes a wire contact for each of the tines 114. Thus, in the embodiment illustrated, the wire contacts 120 include eight wire contacts 120A to 120H. The PCB 124 connects the tines 114A to 114H to the wire contacts 120A to 120H, respectively. Wire contacts, such as wire contacts 120, used in communication jacks are well known in the art and will not be described in detail herein.

Printed Circuit Board

Returning to FIGS. 8 and 9, the PCB 124 has a first forwardly facing side 180 opposite a second rearwardly facing side 181. The PCB 124 includes circuit paths 182A to 182H formed on one or both of the first and second sides 180 and 181. The circuit paths 182A to 182H electrically connect the tines 114A to 114H, respectively, to the wire contacts 120A to 120H, respectively. The PCB 124 includes apertures 186A to 186H configured to receive the first end portion 152 of the tines 114A to 114H, respectively, and electrically connect the tines 114A to 114H to the circuit paths 182A to 182H, respectively. The PCB 124 also includes apertures 188A to 188H configured to receive each of the wire contacts 120A to 120H, respectively, and electrically connect the wire contacts 120A to 120H to the circuit paths 182A to 182H, respectively. As may best be viewed in FIG. 9, wires "W-A" to "W-H" carrying electrical signals may be connected to the wire contacts 120A to 120B, respectively, in a conventional manner. Further, other style contacts and means may be used to electrically connect signals to the tines 114.

Turning to FIG. 10, as mentioned above, the PCB 124 is configured to at least partially close the rearward opening portion 136 of the body 112. The wire contacts 120 are coupled to the PCB 124 such that when the PCB 124 at least partially closes the rearward opening portion 136, the wire contacts 120 extend rearwardly away from the PCB 124 and into the terminal block 128.

Returning to FIGS. 8 and 9, in the embodiment illustrated, the first end portions 152 of the tines 114 may be pressed into the apertures 186A to 186H from the first forwardly facing side 180 of the PCB 124 and the wire contacts 120A to 120H may be pressed into the apertures 188A to 188H, respectively, in the PCB 124 from the second rearwardly facing side 181 of the PCB 124. Thus, the tines 114 and wire contacts 120 extend away from the PCB 124 in opposite directions. The tines 114 may be subsequently soldered into place.

The PCB 124 also includes apertures 190A and 190B configured to receive and support the spring assembly 116.

While the jack 100 is illustrated and discussed as implemented as a Category 6 jack, it should be understood that the present teachings may be useful for other style jacks, including but not limited to Category 3, Category 5, Category 5e and other telecommunication and non-telecommunication jacks, and that such jacks need not utilize a printed circuit board mounting for the tines 114, the spring assembly 116, or other components. Further, the jack 100 need not include a printed circuit board.

Terminal Block

Turning to FIG. 5, the terminal block 128 may be implemented using any terminal block known in the art configured to be assembled with the body 112 to enclose and protect the internal components (i.e., the tines 114, the spring assembly 116, the PCB 124, and portions of the wire contacts 120) of the jack 100. As is apparent to those of ordinary skill in the art, at least a portion of each of the wire contacts 120A to 120H may be accessible from outside the jack 100 so that wires (not shown) may be connected to the wire contacts 120A to 120H. Thus, the terminal block 128 may be configured to provide access to those portions of the wire contacts 120A to 120H.

Figure 13:
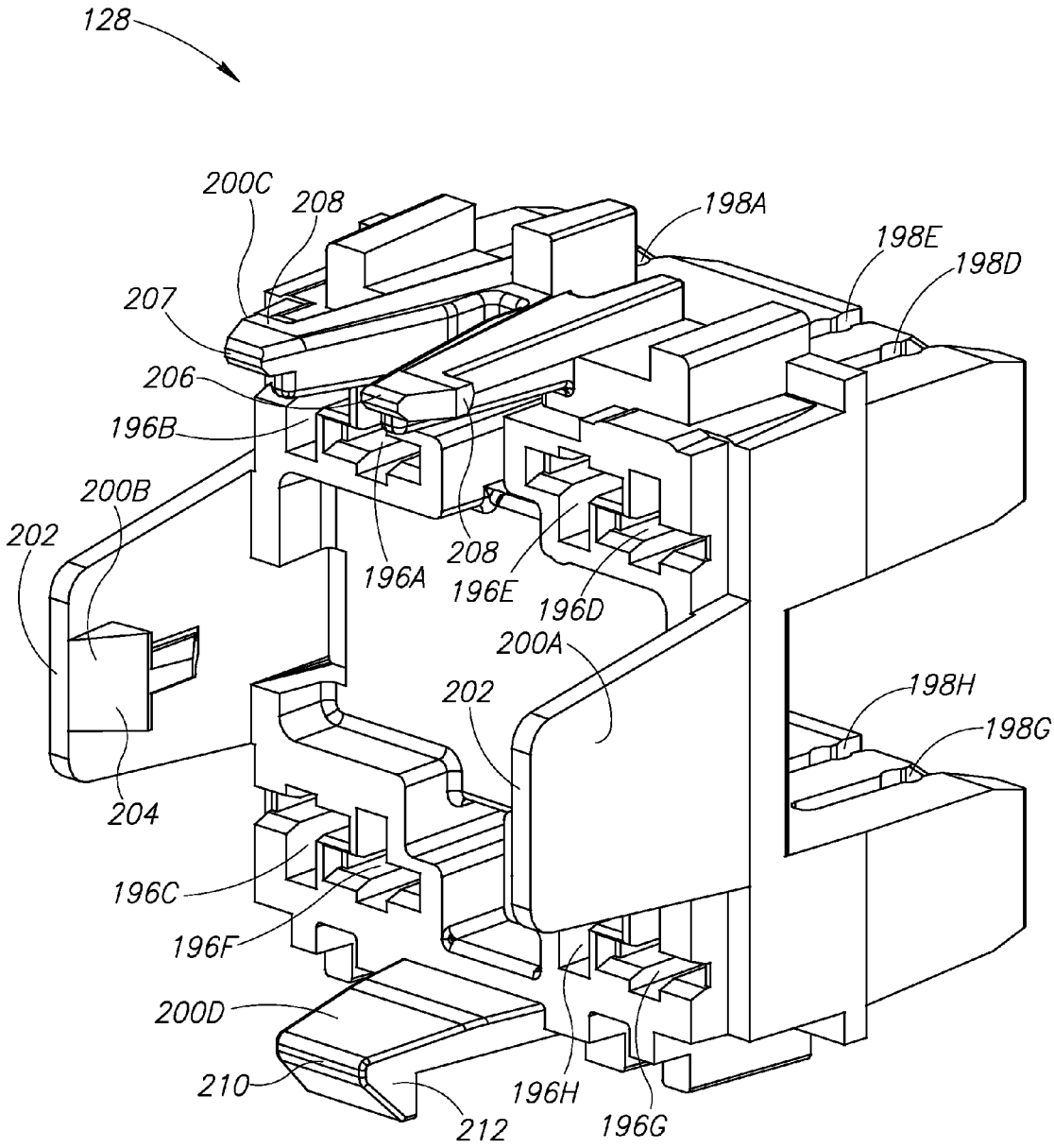
FIG. 13 is a perspective view of the front side of a terminal block of the jack of FIG. 4.

As mentioned above, inside the jack 100, the PCB 124 is positioned adjacent to the receptacle 134 with the tines 114 projecting forward into the receptacle and the wire contacts 120 extending in the opposite direction or rearwardly toward the terminal block 128. The terminal block 128 is mounted on the body 112 adjacent to the skirt 147. When so mounted, the terminal block 128 captures and holds the PCB 124 in place. Referring to FIG. 13, in the embodiment illustrated, the terminal block 128 includes a slot 196A to 196H for each of the wire contacts 120A to 120H, respectively. When the jack 100 is assembled, the wire contacts 120A to 120H (see FIG. 9) are received inside the slots 196A to 196H, respectively. As may best be seen in FIG. 6, each of the slots 196A to 196H has an open rearwardly facing portion 198A to 198H, respectively, through which wires "W-A" to "W-H" (see FIG. 9), respectively, may be connected to the wire contacts 120A to 120H, respectively.

As mentioned above, in the embodiment illustrated in FIG. 7, the body 112 includes the connector portions 138A to 138D configured to effect a snap fit connection between the body 112 and the terminal block 128. In such embodiments, as illustrated in FIG. 13, the terminal block 128 includes one or more connector portions 200A to 200D configured to be connected to the connector portions 138A to 138D, respectively, of the body 112. The connector portions 138A and 138B, which are located on opposite sides of the sidewall 132 of the body 112, each include the aperture 139, which is at least partially defined by the forward facing surfaces 140. The connector portions 200A and 200B of the terminal block 128 are positioned to engage the connector portions 138A and 138B of the body 112. For example, the connector portions 200A and 200B each include a cantilever forward projecting gripping finger 202 having an inwardly extending tab 204 configured to be received inside the aperture 139 and when so received, to bear against the forward facing surface 140.

As mentioned above, the connector portion 138C includes the channel 141 defined between the spaced part wall sections 142 and 143 each having a forward facing surface 144 (see FIG. 10). The connector portion 200C of the terminal block 128 is positioned to engage the connector portion 138C of the body 112. For example, the connector portion 200C may include a pair of cantilever forward projecting gripping fingers 206 and 207 configured to be received inside the channel 141 between the spaced part wall sections 142 and 143. The gripping fingers 206 and 207 may each include a tab 208 configured to engage the forward facing surface 144 of the wall sections 142 and 143, respectively, when the gripping fingers 206 and 207 are received inside the channel 141.

As mentioned above and illustrated in FIG. 7, the connector portion 138D includes the recess or aperture 145, which is adjacent the forward facing surface 146 (best viewed in FIG. 10). The connector portion 200D of the terminal block 128 is positioned to engage the connector portion 138D of the body 112. For example, the connector portion 200D may include a cantilever forward projecting gripping finger 210 configured to be received inside the aperture 145. The gripping fingers 210 may each include a tab 212 configured to engage the forward facing surface 146 (best viewed in FIG. 10) when the gripping finger 210 is received inside the aperture 145.

Alternate methods and structures for coupling the body 112 and the terminal block 128 together are known in the art and the present teachings are not limited to use with any particular method or structure. The structures discussed above are provided merely for illustrative purposes and are not intended to be limiting.

Spring Assembly

As illustrated in FIG. 10, the spring assembly 116 is positioned adjacent to the tines 114 to provide an increased contact force and resiliency compared to the contact force produced by the tines alone in response to being bent by the plug contacts 20 of the plug 18 as the plug is inserted into the interior receptacle 134. Thus, the tines 114 need not be longer than desired to provide good electrical performance. The increased resiliency allows the insertion of legacy plugs (not shown) into the interior receptacle 134 and the resulting flexure of the tines 114 in response thereto, without permanent deformation of the tines.

Figure 14:
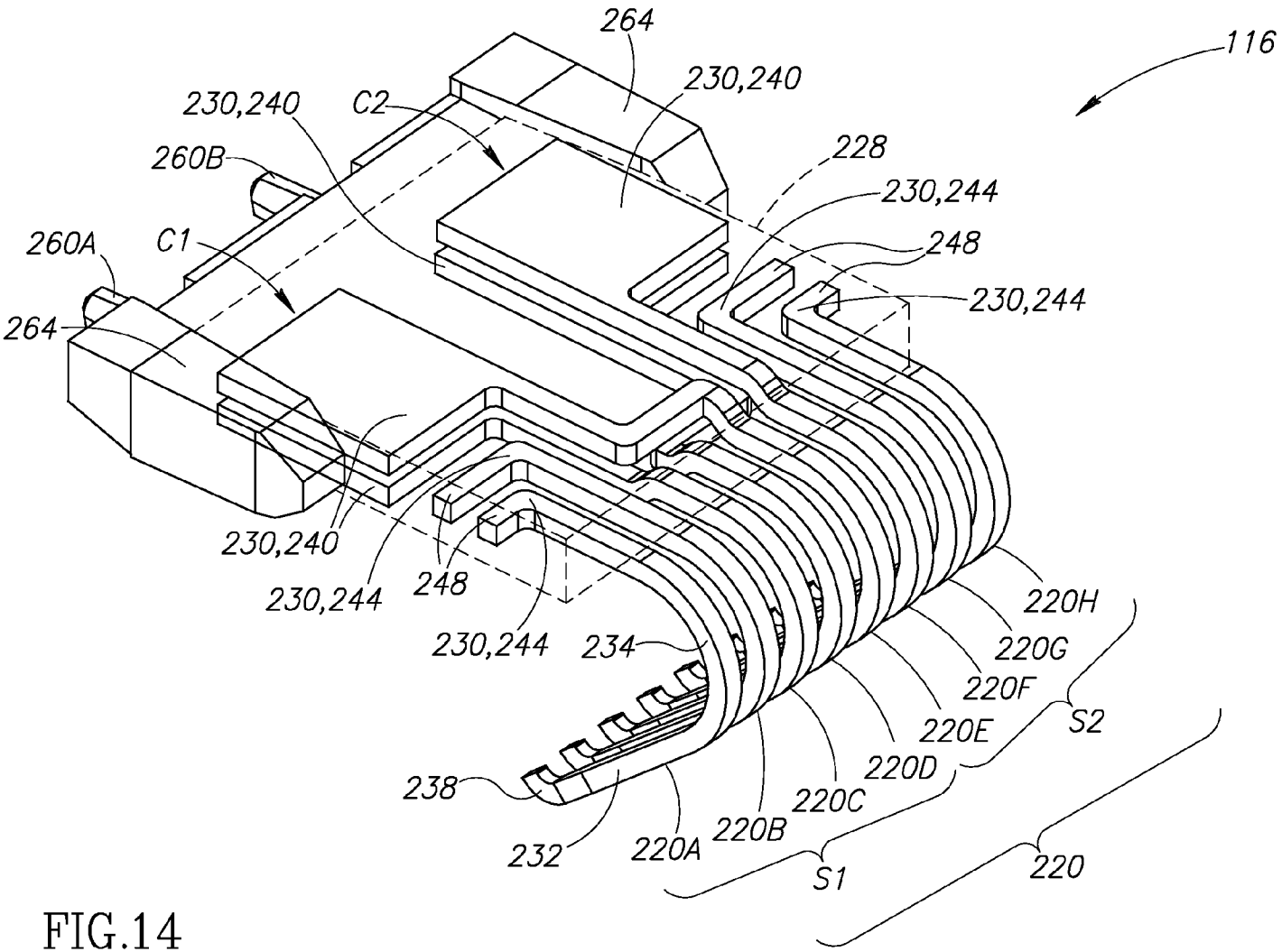
FIG. 14 is a perspective view of the front side of the spring assembly of the jack of FIG. 4 with a portion of the body portion illustrated as transparent to show anchor portions of the spring arms.

Turning to FIG. 14, the spring assembly 116 includes spring members or arms 220 each connected to a dielectric or non-conductive base 228. As may best be viewed in FIG. 11, the spring assembly 116 includes a spring arm 220 for each of the tines 114. Thus, in the embodiment illustrated, the spring arms 220 include eight individual spring arms 220A to 220H, which correspond to the tines 114A to 114H, respectively. The spring arms 220A to 220H extend forward from the spring assembly base 228. At least one of the spring arms 220C to 220F are constructed from a conductive material. In the embodiment illustrated, the spring arms 220A to 220H are all constructed from a conductive material.

Returning to FIG. 10, each of the spring arms 220 includes an anchored portion 230, a tine engaging portion 232, and a bent portion 234 positioned between the anchored portion 230 and the tine engaging portion 232. The anchored portion 230 is coupled inside the non-conductive base 228 and is insulated thereby. Further, the non-conductive base 228 insulates the spring arms 220A to 220H from one another. The other portions of the spring arms 220 are located outside the non-conductive base 228 and are not insulated thereby. The bent portions 234 position the tine engaging portions 232 of the spring arms 220 to engage the second contact portions 160 of the tines 114. Opposite the bent portion 234, the tine engaging portion 232 has a free end portion 238.

Turning to FIG. 14, the anchored portions 230 of the center four spring arms 220C to 220F each include a capacitor plate portion 240. The capacitor plate portion 240 of the spring arm 220C is adjacent the capacitor plate portion 240 of the spring arm 220E to form a first capacitor "C1." The capacitor plate portion 240 of the spring arm 220D is adjacent the capacitor plate portion 240 of the spring arm 220F to form a second capacitor "C2" spaced apart from the first capacitor "C1."

The anchored portions 230 of the spring arms 220A, 220B, 220G and 220H each include a bent portion 244 that positions an end portion 248 to extend laterally outwardly away from the rest of the spring arm. The end portions 248 of the spring arms 220A and 220B extend laterally away from the spring arms 220C to 220H in a first direction that is opposite a second direction in which the end portions 248 of the spring arms 220G and 220H extend away from the spring arms 220A to 220F. The bent portions 244 may help maintain the positioning of the spring arms 220A, 220B, 220G and 220H inside the non-conductive base 228 when force is applied to the arms 220A, 220B, 220G and 220H. The size and shape of the bent portions 244 also can be designed so that crosstalk between the second pair "P2" to the third pair "P3" and the third pair "P3" to the fourth pair "P4" can be reduced.

As shown in FIG. 14, the non-conductive base 228 includes projections 260A and 260B configured to be received into the apertures 190A and 190B, respectively, formed in the PCB 124 and illustrated in FIG. 8. The projections 260A and 260B are inserted into the apertures 190A and 190B, respectively, along the first forwardly facing side 180 of the PCB 124 to position the spring arms 220 on the same side of the PCB 124 as the tines 114. Turning to FIG. 5, the PCB 124 with the tines 114, the spring assembly 116, and the wire contacts 120 attached thereto is received inside the skirt 147 adjacent the rearward opening portion 136 of the sidewall 132 of the body 112. The PCB 124 is positioned adjacent to the receptacle 134 with both the tines 114 and the spring arms 220 projecting forward into the receptacle and the wire contacts 120 extending rearwardly into the terminal block 128 as described above.

The non-conductive base 228 may include guides 264 (see FIG. 14) configured to travel along the optional guide rails 149 (see FIG. 7) formed in the body 112. The rails 149 may align and hold the guides 264, as best shown in FIGS. 9 and 11, and thereby align and hold the conductive spring arms 220 in position for contact with the tines 114.

Figure 3:
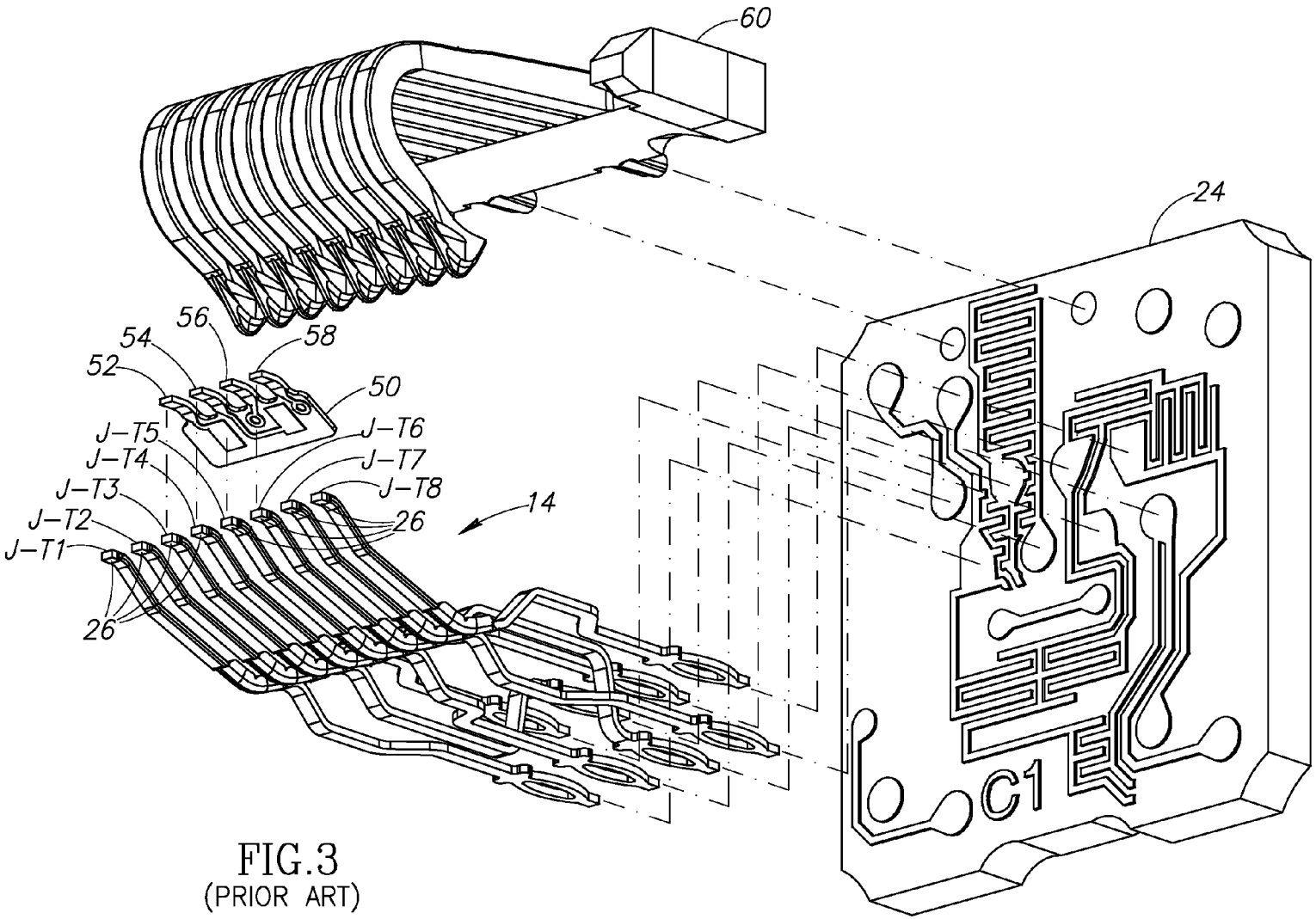
FIG.3 (PRIOR ART)
FIG. 3 is a perspective view of the plurality of tines, the printed circuit board, a flexible printed circuit board configured to be soldered to the plurality of tines to provide crosstalk compensation, and an alternate embodiment of a spring assembly for use inside the jack of FIG. 1.

Turning to FIG. 10, like the prior art spring arms 44 depicted in FIGS. 1-3, the spring arms 220 help effect contact between the tines 114 and the plug contacts 20. Inside the receptacle 134, the spring arms 220A to 220H are positioned immediately adjacent to the tines 114A to 114H, respectively. The free end portions 238 of the spring arms 220A to 220H are configured to contact the second contact portion 160 of the tines 114A to 114H, respectively, on the second side 150B of the tine while the first sides 150A of the tines 114A to 114H are contacting the plug contacts 20A to 20H, respectively.

As may be viewed in FIGS. 9 and 11, each of the spring arms 220A to 220H is positioned such that their free end portions 238 are received inside the channel 163 of the second contact portions 160 of the tines 114A to 114H, respectively. The first and second side rails 162A and 162B help maintain alignment of the spring arms 220A to 220H with the tines 114A to 114H, respectively. The first and second side rails 162A and 162B also allow the spring arms 220A to 220H to slide forward and backward along the tines 114A to 114H, respectively, as the tines and spring arms are deflected by engagement with the plug contacts 20A to 20H, respectively.

Returning to FIG. 10, as described above, when the plug 18 is inserted into the interior receptacle 134, the plug contacts 20A to 20H contact the tines 114A to 114H, respectively, causing them to deflect. As the tines 114A to 114H are deflected, they press against the free end portions 238 of the spring arms 220A to 220H, respectively, causing the spring arms to flex or deflect. The free end portions 238 move away from the plug contacts 20 with a small rearward component because the tines 114 each deflect along an arcuate path of motion.

The spring arms 220 are separated laterally from each other to allow the spring arms 220 to move independently. The spring arms 220A to 220H apply a supplemental contact force to the tines 114A and 114B which opposes the movement of the tines in response to the plug contacts. The supplemental contact force applied by the spring arms 220 is transmitted to the plug contacts 20 by the tines 114. The supplemental contact force increases the contact force between the tines 114 and the plug contacts 20 (which for each of the tines 114, is generally the sum of the first force and the supplemental contact force). The supplemental contact force also causes the tine 114 to respond as if the tine has greater resiliency than that of a tine unassisted by the spring arm 220. The supplemental contact force assists the return movement of the tine when the plug 18 is removed from the receptacle 134 and allowed to return from its deflected position to its original position before the plug was inserted into the receptacle. Because each spring arm 220 operates independently on the one of the tines 114 engaged by the spring arm 220, the supplemental contact force is provided to a particular tine even if one or more of the other tines are not engaged by a plug contact 20.

The supplemental contact force may improve the ability of the jack 100 to receive legacy plugs (not shown) having substantially different sizes and styles than a Category 6 plug (e.g., the plug 18), when inserted into the receptacle 134 by allowing an increased range of elastic deflection without undesirable permanent deformation of the tines 114. The independent operation of the spring arms 220 allows the use of legacy plugs of many configurations, size and number of plug contacts that cause some tines 114 to deflect by large amounts, such as when engaged by sidewalls or other non-contact portions of the plug, while other tines do not and still produce good electrical contact with the contacts of the legacy plug and without damage to the tines. Again, the increased resiliency is accomplished without the need to lengthen and/or thicken the tines to achieve it.

As explained above, the free end portions 238 of the spring arms 220 are configured to contact the second contact portions 160 of the tines 114. Ones of the spring arms 220A to 220H that are conductive and contact one of the tines 114 form an electrical connection therewith. Ones of the spring arms 220A to 220H that are non-conductive and contact one of the tines 114 will not form an electrical connection therewith but may still provide supplemental contact force thereto. In the embodiment depicted, all of the spring arms 220A to 220H are conductive. Thus, when the spring arms 220A to 220H are in contact with the tines 114A to 114H, respectively, the spring arms 220A to 220H are electrically coupled to the tines 114A to 114H, respectively.

As may be viewed in FIGS. 11 and 12, the spring arms 220A and 220B are electrically connected to the tines 114A and 114B, respectively, which are the tines of the second pair "P2." Turning to FIG. 14, the spring arms 220A and 220B are substantially parallel to one another and this parallel arrangement and close positioning of the spring arm 220A and 220B relative to one another may help reduce crosstalk in the tines 114A and 114B.

Returning to FIGS. 11 and 12, the spring arm 220G and 220H are electrically connected to the tines 114G and 114H, respectively, which are the tines of the fourth pair "P4." Turning to FIG. 14, the spring arms 220G and 220H are substantially parallel to one another and this parallel arrangement and close positioning of the spring arm 220G and 220H relative to one another may help reduce crosstalk in the tines 114G and 114H.

As may be viewed in FIGS. 11 and 12, the spring arms 220C and 220F are electrically connected to the tines 114C and 114F, respectively, which are the tines of the split third pair "P3" and the spring arms 220D and 220E are electrically connected to the tines 114D and 114E, respectively, which are the tines of the first pair "P1." The tine 114F (of the third pair "P3") is adjacent the tine 114E (of the first pair "P1"). This adjacency may allow the tine 114F to induce a signal (crosstalk) in the tine 114E via capacitive (and possibly inductive) coupling between the tines 114F and 114E. However, such a signal may be at least partially counteracted if the tine 114E were also adjacent the other tine (i.e., the tine 114C) of the third pair "P3." This is accomplished by the spring arms 220C and 220E, which capacitively couple the tines 114C and 114E together. In other words, the first capacitor "C1" capacitively couples the tines 114C and 114E together to thereby at least partially counteract crosstalk between the tines 114F and 114E.

Similarly, the tine 114C (of the third pair "P3") is adjacent the tine 114D (of the first pair "P1"). This adjacency may allow the tine 114C to induce a signal (crosstalk) in the tine 114D via capacitive (and possibly inductive) coupling between the tines 114C and 114D. However, such a signal could be at least partially counteracted if the tine 114D were also adjacent the other tine (i.e., the tine 114F) of the third pair "P3." This is accomplished by the spring arms 220D and 220F, which capacitively couple the tines 114D and 114F. In other words, the second capacitor "C2" capacitively couples the tines 114D and 114F together to thereby at least partially counteract crosstalk between the tines 114C and 114D.

In the manner described above, the first and second capacitors "C1" and "C2" provide crosstalk compensation for the tines 114C and 114F of the third or split pair "P3" and the tines 114E and 114F of the first pair "P1" positioned between the tines 114C and 114F of the third pair "P3." Thus, the flexible PCB 50 (see FIG. 3) used in the prior art jack 10 is not required inside the jack 100.

Returning to FIG. 14, by way of a non-limiting example, the spring assembly 116 may be constructed by molding the non-conductive base 228 with the anchored portions 230 of the spring arms 220 placed inside a mold to thereby embed the anchored portions 230 inside the non-conductive base 228. In such an implementation, the spring arms 220 are non-removably coupled to the non-conductive base 228. However, in alternate embodiments, the non-conductive base 228 may include two or more parts that, when connected together (removably or permanently), form the non-conductive base 228. The anchored portions 230 may be placed inside or between two or more of these parts before they are connected together (removably or permanently). For example, the non-conductive base 228 may be constructed in a manner similar to that of the base 46 described in the Background Section and illustrated in FIG. 2, which has the first and second portions 46*a* and 46*b*, with the spring arms 220 sandwiched between the first and second portions 46*a* and 46*b*.

In the embodiment illustrated, the spring arms 220A to 220D are substantially identical to the spring arms 220E to 220H. However, in the spring assembly 116, the spring arms 220E to 220H are reversed in orientation and arrangement relative to the spring arms 220A to 220D. Because the spring arms 220A to 220D are substantially identical to the spring arms 220E to 220H, the same process may be used to construct the spring arms 220A to 220D that is used to construct the spring arms 220E to 220H. Thus, for the sake of clarity, the spring arms 220A to 220D will be referred to as a first set of spring arms "S1" and the spring arms 220E to 220H will be referred to as a second set of spring arms "S2."

Figure 15:
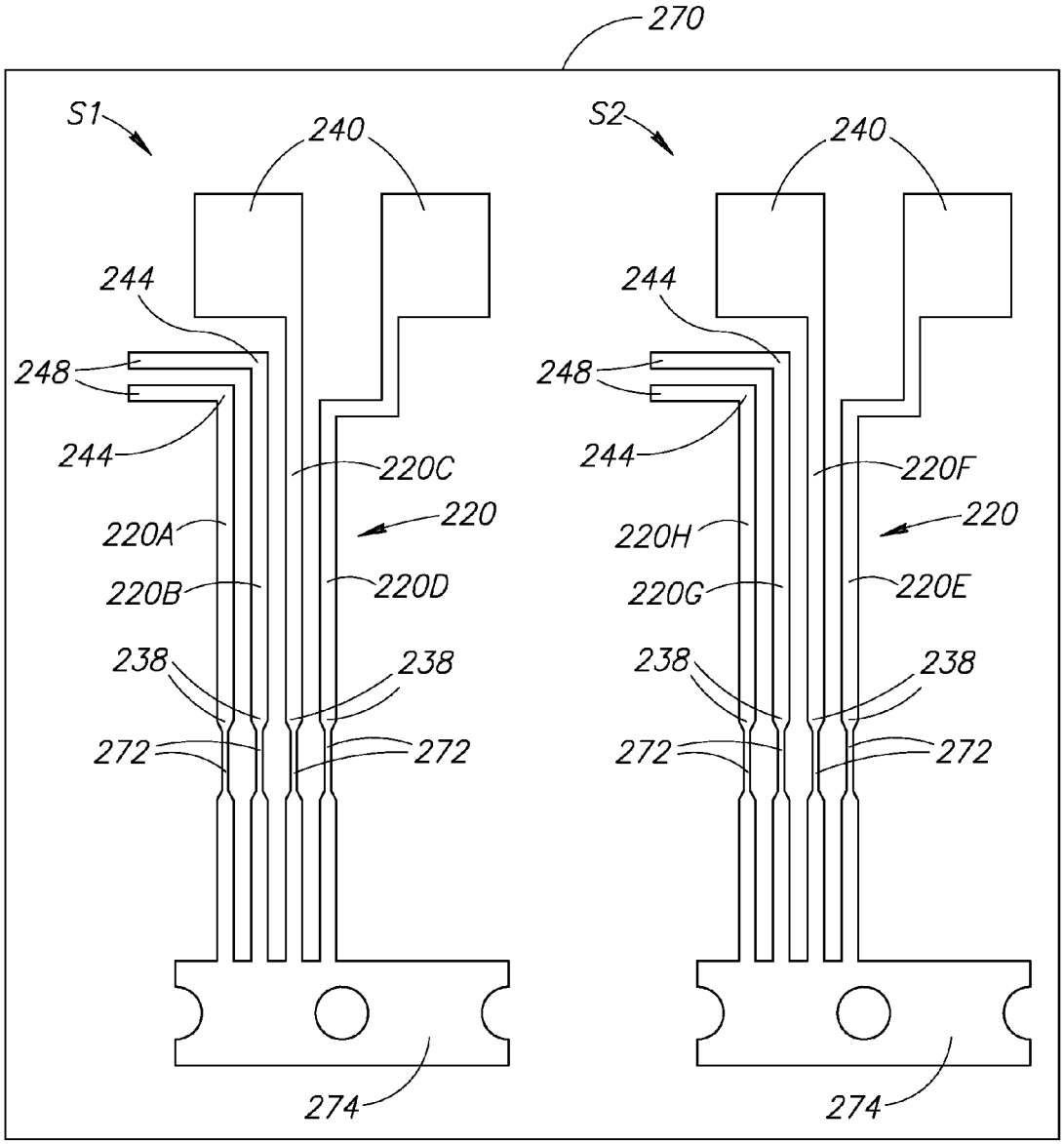
FIG. 15 is a sheet of conductive material cutout to define four of the eight spring arms connected together by a breakaway portion connected to a transverse portion.

Referring to FIG. 15, each of the first and second sets of spring arms "S1" and "S2" illustrated in FIG. 14 may be constructed in substantially the same manner from a flat sheet 270 of conductive material (e.g., a sheet of phosphor bronze). The same sheet 270 of conductive material or different sheets of conductive material may be used to construct the first and second sets of spring arms "S1" and "S2."

In a first step, the sheet 270 is etched or cut to define the spring arms 220A-220D of the first set of spring arms "S1," which are each attached to a breakaway portion 272 that is connected to a transverse connecting portion 274. The same sheet 270 or a different sheet is etched or cut to define the spring arms 220E-220H of the second set of spring arms "S2," which are each attached to a breakaway portion 272 that is connected to a transverse connecting portion 274. Then, the spring arms 220A to 220D are bent or otherwise formed into their final shape with the transverse connecting portion 274 attached and the spring arms 220E to 220H are bent or otherwise formed into their final shape with the transverse connecting portion 274 attached. As is apparent to those of ordinary skill in the art, the transverse connecting portions 274 may be used to grip and/or hold the spring arms 220 of the first and second sets "S1" and "S2" as they are fabricated.

Next, referring to FIG. 14, the anchored portions 230 of the spring arms 220 are placed inside the mold (not shown) used to create the non-conductive base 228. The transverse connecting portions 274 (see FIG. 15) may be used to grip and/or hold the spring arms 220 as a unit as their anchored portions 230 are placed inside the mold. As mentioned above, in the spring assembly 116, the second set of spring arms "S2" are reversed in orientation and arrangement relative to the first of spring arms "S1." Therefore, the first set of spring arms "S1" is placed in the mold in an upright position and the second set of spring arms "S2" substantially identical to the first set of spring arms "S1" is placed in the mold in an upside down orientation. Then, the non-conductive base 228 is molded from a non-conductive material with the first and second set of spring arms "S1" and "S2" disposed inside.

After the non-conductive base 228 has been molded and is sufficiently hardened, the transverse connecting portions 274 (see FIG. 15) are removed from the first set of spring arms "S1" to separate the spring arms 220A to 220D from one another and the transverse connecting portions 274 are removed from the second set of spring arms "S2" to separate the spring arms 220E to 220H from one another. By way of a non-limiting example, the transverse connecting portions 274 (see FIG. 15) may be removed by breaking the breakaway portions 272 (see FIG. 15).

Optional Shield Enclosure

Referring to FIG. 5, the optional shield enclosure 130 may be configured to reduce crosstalk and/or noise transmitted between adjacent wire contacts 120. Such shield enclosures are known in the art and will not be described herein. An example of a suitable shield enclosure that may be used to implement the optional shield enclosure 130 is described in detail in U.S. Pat. No. 7,273,396, which is incorporated herein by reference in its entirety.

Simulation and Test Results

Computer generated mechanical simulations have shown that the spring arms 220 of the spring assembly 116 when constructed from phosphor bronze may be configured to provide greater than about 50 grams of supplemental contact force to the tines 114. This is believed to be a sufficient amount. As is apparent to those of ordinarily skill in the art, the amount of supplemental contact force supplied by the spring arms 220 may be changed (increased or decreased) by changing the geometry of the spring arms 220 and/or the material used to construct the spring arms 220. In this manner, a desired amount of supplemental contact force may be achieved.

Computer generated mechanical simulations have also shown that the spring arms 220 may experience stresses of about 88 ksi, which are below the yield strength of phosphor bronze (which is about 95 ksi).

Tests performed on physical prototypes held together with epoxy and created using chemically etched leadframes have demonstrated that the jack 100 may be configured to satisfy the Category 6A requirements.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A spring assembly for use in a communications jack comprising a plurality of jack contacts comprising a first jack contact, a second jack contact, a third jack contact, and a fourth jack contact, the first jack contact and the second jack contact being configured to carry a first differential signal, the third jack contact and the fourth jack contact being configured to carry a second differential signal, the jack being configured to receive a communications plug having a plug contact corresponding to each of the plurality of jack contacts, each of the plurality of jack contacts being electrically connected to a corresponding one of the plug contacts when the communications plug is received by the communications jack, the spring assembly comprising:

a corresponding conductive spring member for each of the plurality of jack contacts, each of the conductive spring members being electrically connected to a corresponding jack contact and configured to bias the corresponding jack contact against the corresponding plug contact to which the corresponding jack contact is electrically connected, the conductive spring member electrically connected to the first jack contact being capacitively coupled to the third jack contact to reduce crosstalk between the first jack contact and the second jack contact, and the conductive spring member electrically connected to the fourth jack contact being capacitively coupled to the second jack contact to reduce crosstalk between the fourth jack contact and the third jack contact.

2. The spring assembly of claim 1, further comprising:

a non-conductive base portion configured to position the conductive spring members relative to the jack contacts.

3. A spring assembly for use in a communications jack comprising a first jack contact, a second jack contact, a third jack contact, and a fourth jack contact, the second and third jack contacts being positioned between the first and fourth jack contacts with the second jack contact adjacent the first jack contact and the third jack contact adjacent the fourth jack contact, the spring assembly comprising;

a first conductive spring member comprising a first capacitor plate and a first jack contact portion, the first jack contact portion being configured to engage with the first jack contact and form an electrical connection therewith;

a second conductive spring member comprising a second capacitor plate and a second jack contact portion, the second jack contact portion being configured to engage with the second jack contact and form an electrical connection therewith;

a third conductive spring member comprising a third capacitor plate and a third jack contact portion, the third jack contact portion being configured to engage with the third jack contact and form an electrical connection therewith; and a fourth conductive spring member comprising a fourth capacitor plate and a fourth jack contact portion, the fourth jack contact portion being configured to engage with the fourth jack contact and form an electrical connection therewith, the first capacitor plate being positioned relative to the third capacitor plate to form a first capacitor, and the second capacitor plate being positioned relative to the fourth capacitor plate to form a second capacitor spaced apart from the first capacitor.

4. The spring assembly of claim 3 for use in a communications jack configured to receive a plug comprising a first plug contact, a second plug contact, a third plug contact, and a fourth plug contact, the first plug contact being configured to engage the first jack contact and when so engaged, deflect the first jack contact, the second plug contact being configured to engage the second jack contact and when so engaged, deflect the second jack contact, the third plug contact being configured to engage the third jack contact and when so engaged, deflect the third jack contact, and the fourth plug contact being configured to engage the fourth jack contact and when so engaged, deflect the fourth jack contact, wherein the first conductive spring member is further configured to apply a biasing force to the first jack contact to limit the deflection of the first jack contact caused by the first plug contact, the second conductive spring member is further configured to apply a biasing force to the second jack contact to limit the deflection of the second jack contact caused by the second plug contact, the third conductive spring member is further configured to apply a biasing force to the third jack contact to limit the deflection of the third jack contact caused by the third plug contact, and the fourth conductive spring member is further configured to apply a biasing force to the fourth jack contact to limit the deflection of the fourth jack contact caused by the fourth plug contact.

5. The spring assembly of claim 4 wherein the first, second, third, and fourth jack contacts each comprise a first side opposite a second side, the first, second, third, and fourth plug contacts engage the first sides of the first, second, third, and fourth jack contacts, respectively, and the first, second, third, and fourth conductive spring members engage the second sides of the first, second, third, and fourth jack contacts, respectively.

6. The spring assembly of claim 3 wherein the first, second, third, and fourth conductive spring members each comprise a bent portion configured to position the first, second, third, and fourth jack contact portions, respectively, for engagement with the first, second, third, and fourth jack contacts, respectively.

7. The spring assembly of claim 3 for use in a communications jack further comprising a printed circuit board comprising a first circuit electrically coupled to the first jack contact, a second circuit electrically coupled to the second jack contact, a third circuit electrically coupled to the third jack contact, and a fourth circuit electrically coupled to the fourth jack contact, the spring assembly further comprising:

a non-conductive base portion connected to the printed circuit board and spaced apart from the first, second, third, and fourth circuits thereof, the non-conductive base portion insulating the first, second, third, and fourth conductive spring members from one another.

8. The spring assembly of claim 3 for use in a communications jack further comprising a body comprising guiderails configured to position the spring assembly relative to the first, second, third, and fourth jack contacts, the spring assembly further comprising:

a non-conductive base portion comprising guides configured to engage the guiderails and be positioned thereby, the first, second, third, and fourth conductive spring members being coupled to the non-conductive base portion and positionable by the non-conductive base portion relative to the first, second, third, and fourth jack contacts.

9. The spring assembly of claim 3 for use in a communications jack further comprising a fifth jack contact, a sixth jack contact, a seventh jack contact, and an eighth jack contact, the fifth and sixth jack contacts being adjacent the first jack contact, and the seventh and eighth jack contacts being adjacent the fourth jack contact, the spring assembly further comprising;

a fifth conductive spring member comprising a fifth jack contact portion configured to engage with the fifth jack contact and form an electrical connection therewith;

a sixth conductive spring member comprising a sixth jack contact portion configured to engage with the sixth jack contact and form an electrical connection therewith;

a seventh conductive spring member comprising a seventh jack contact portion configured to engage with the seventh jack contact and form an electrical connection therewith; and an eighth conductive spring member comprising a eighth jack contact portion configured to engage with the eighth jack contact and form an electrical connection therewith.

10. The spring assembly of claim 9, wherein the fifth and sixth conductive spring members are positioned to reduce crosstalk and the seventh and eighth conductive spring members are positioned to reduce crosstalk.

11. The spring assembly of claim 3 for use in a communications jack further comprising a fifth jack contact, a sixth jack contact, a seventh jack contact, and an eighth jack contact, the fifth and sixth jack contacts being adjacent the first jack contact, and the seventh and eighth jack contacts being adjacent the fourth jack contact, the spring assembly further comprising;

a non-conductive base portion, the first, second, third, and fourth capacitor plates of the first, second, third, and fourth conductive spring members, respectively, being spaced apart from one another and positioned inside the non-conductive base portion;

a fifth conductive spring member comprising a fifth anchor portion and a fifth jack contact portion, the fifth jack contact portion being configured to engage with the fifth jack contact and form an electrical connection therewith;

a sixth conductive spring member comprising a sixth anchor portion and a sixth jack contact portion, the sixth jack contact portion being configured to engage with the sixth jack contact and form an electrical connection therewith;

a seventh conductive spring member comprising a seventh anchor portion and a seventh jack contact portion, the seventh jack contact portion being configured to engage with the seventh jack contact and form an electrical connection therewith; and an eighth conductive spring member comprising an eighth anchor portion and an eighth jack contact portion, the eighth jack contact portion being configured to engage with the eighth jack contact and form an electrical connection therewith, the fifth, sixth, seventh, and eighth anchor portions of the fifth, sixth, seventh, and eighth conductive spring members, respectively, being spaced apart from one another and positioned inside the non-conductive base portion.

12. The spring assembly of claim 11, wherein the first capacitor plate is formed in a first end portion of the first conductive spring member and the first jack contact portion is formed in a second end portion of the first conductive spring member opposite the first end portion, the second capacitor plate is formed in a first end portion of the second conductive spring member and the second jack contact portion is formed in a second end portion of the second conductive spring member opposite the first end portion, the third capacitor plate is formed in a first end portion of the third conductive spring member and the third jack contact portion is formed in a second end portion of the third conductive spring member opposite the first end portion, the fourth capacitor plate is formed in a first end portion of the fourth conductive spring member and the fourth jack contact portion is formed in a second end portion of the fourth conductive spring member opposite the first end portion, the fifth anchor portion is formed in a first end portion of the fifth conductive spring member and the fifth jack contact portion is formed in a second end portion of the fifth conductive spring member opposite the first end portion, the sixth anchor portion is formed in a first end portion of the sixth conductive spring member and the sixth jack contact portion is formed in a second end portion of the sixth conductive spring member opposite the first end portion, the seventh anchor portion is formed in a first end portion of the seventh conductive spring member and the seventh jack contact portion is formed in a second end portion of the seventh conductive spring member opposite the first end portion, and the eighth anchor portion is formed in a first end portion of the eighth conductive spring member and the eighth jack contact portion is formed in a second end portion of the eighth conductive spring member opposite the first end portion.

13. The spring assembly of claim 11, wherein the fifth anchor portion is formed in a first end portion of the fifth conductive spring member and the fifth jack contact portion is formed in a second end portion of the fifth conductive spring member opposite the first end portion, and the fifth anchor portion further comprises a bent portion configured to resist removal of the fifth conductive spring member from the non-conductive base portion, the sixth anchor portion is formed in a first end portion of the sixth conductive spring member and the sixth jack contact portion is formed in a second end portion of the sixth conductive spring member opposite the first end portion, and the sixth anchor portion further comprises a bent portion configured to resist removal of the sixth conductive spring member from the non-conductive base portion the seventh anchor portion is formed in a first end portion of the seventh conductive spring member and the seventh jack contact portion is formed in a second end portion of the seventh conductive spring member opposite the first end portion, and the seventh anchor portion further comprises a bent portion configured to resist removal of the seventh conductive spring member from the non-conductive base portion, and the eighth anchor portion is formed in a first end portion of the eighth conductive spring member and the eighth jack contact portion is formed in a second end portion of the eighth conductive spring member opposite the first end portion, and the eighth anchor portion further comprises a bent portion configured to resist removal of the eighth conductive spring member from the non-conductive base portion.

14. The spring assembly of claim 11 wherein the first, second, third, fourth, fifth, sixth, seventh, and eighth conductive spring members each comprise a bent portion configured to position the first, second, third, fourth, fifth, sixth, seventh, and eighth jack contact portions, respectively, for engagement with the first, second, third, fourth, fifth, sixth, seventh, and eighth jack contacts, respectively.

15. A spring assembly for use in a communications jack configured to receive a communications plug, the jack comprising a first jack contact, a second jack contact, a third jack contact, and a fourth jack contact, the first and fourth jack contacts comprising a first signaling pair, the second and third jack contacts comprising a second signaling pair, the second and third jack contacts being positioned between the first and fourth jack contacts with the second jack contact adjacent the first jack contact and the third jack contact adjacent the fourth jack contact, the first, second, third, and fourth jack contacts being deflected by the plug when the plug is received by the jack, the spring assembly comprising;

a first conductive spring member electrically connected to the first jack contact and configured to apply a biasing force to the first jack contact to lessen the deflection of the first jack contact by the plug;

means for capacitively coupling the first conductive spring member with the third jack contact;

a second spring member configured to apply a biasing force to the second jack contact to lessen the deflection of the second jack contact by the plug;

a third conductive spring member electrically connected to the third jack contact and configured to apply a biasing force to the third jack contact to lessen the deflection of the third jack contact by the plug;

means for capacitively coupling the third conductive spring member with the first jack contact; and a fourth spring member configured to apply a biasing force to the fourth jack contact to lessen the deflection of the fourth jack contact by the plug.

16. The spring assembly of claim 15 wherein the second spring member is conductive and electrically connected to the second jack contact, and the fourth spring member is conductive and electrically connected to the fourth jack contact.

17. The spring assembly of claim 16 further comprising:

means for capacitively coupling the second conductive spring member with the fourth jack contact; and means for capacitively coupling the fourth conductive spring member with the second jack contact.

18. A spring assembly for use in a communications jack configured to receive a communications plug, the jack comprising a first jack contact, a second jack contact, a third jack contact, a fourth jack contact, a fifth jack contact, a sixth jack contact, a seventh jack contact, and an eighth jack contact arranged serially in an array, wherein the fourth and fifth jack contacts comprise a first signaling pair, the first and second jack contacts comprise a second signaling pair, the third and sixth jack contacts comprise a third signaling pair, and the seventh and eighth jack contacts comprise a fourth signaling pair, the first, second, third, fourth, fifth, sixth, seventh, and eighth jack contacts being deflected by the plug when the plug is received by the jack, the spring assembly comprising;

a first spring member configured to apply a biasing force to the first jack contact to lessen the deflection of the first jack contact by the plug;

a second spring member configured to apply a biasing force to the second jack contact to lessen the deflection of the second jack contact by the plug;

a third conductive spring member electrically connected to the third jack contact and configured to apply a biasing force to the third jack contact to lessen the deflection of the third jack contact by the plug;

means for capacitively coupling the third conductive spring member with the fifth jack contact;

a fourth spring member configured to apply a biasing force to the fourth jack contact to lessen the deflection of the fourth jack contact by the plug;

a fifth conductive spring member electrically connected to the fifth jack contact and configured to apply a biasing force to the fifth jack contact to lessen the deflection of the fifth jack contact by the plug;

means for capacitively coupling the fifth conductive spring member with the third jack contact;

a sixth spring member configured to apply a biasing force to the sixth jack contact to lessen the deflection of the sixth jack contact by the plug;

a seventh spring member configured to apply a biasing force to the seventh jack contact to lessen the deflection of the seventh jack contact by the plug; and an eighth spring member configured to apply a biasing force to the eighth jack contact to lessen the deflection of the eighth jack contact by the plug.

19. The spring assembly of claim 18 wherein the fourth spring member is conductive and electrically connected to the fourth jack contact, and the sixth spring member is conductive and electrically connected to the sixth jack contact.

20. The spring assembly of claim 19 further comprising:

means for capacitively coupling the fourth conductive spring member with the sixth jack contact; and means for capacitively coupling the sixth conductive spring member with the fourth jack contact.

21. The spring assembly of claim 18 wherein the first spring member is conductive and electrically connected to the first jack contact, the second spring member is conductive and electrically connected to the second jack contact, the seventh spring member is conductive and electrically connected to the seventh jack contact, and the eighth spring member is conductive and electrically connected to the eighth jack contact.

22. A communications jack for use with a communications plug comprising a plurality of plug contacts, the jack comprising:

a plurality of jack contacts comprising a first jack contact, a second jack contact, a third jack contact, and a fourth jack contact, the first jack contact and the second jack contact being configured to carry a first differential signal, the third jack contact and the fourth jack contact being configured to carry a second differential signal;

a receptacle configured to receive the communications plug, the plurality of jack contacts being positioned inside the receptacle to be contacted by the plurality of plug contacts of the communications plug when the communications plug is received inside the receptacle; and a spring assembly comprising a corresponding spring member for each of the plurality of jack contacts, each of the spring members being configured to bias the corresponding jack contact against a corresponding one of the plurality of plug contacts when the communications plug is received inside the receptacle, the spring member corresponding to the first jack contact being conductive, electrically connected to the first jack contact, and capacitively coupled to the third jack contact to reduce crosstalk between the first jack contact and the second jack contact, and the spring member corresponding to the fourth jack contact being conductive, electrically connected to the fourth jack contact, and capacitively coupled to the second jack contact to reduce crosstalk between the fourth jack contact and the third jack contact.

23. The communications jack of claim 22, further comprising:

a substrate, the plurality of jack contacts being mounted on the substrate and positioned thereby inside the receptacle to be contacted by the plurality of plug contacts of the communications plug, the spring assembly being mounted on the substrate positioned thereby adjacent to the plurality of jack contacts inside the receptacle.

24. The communications jack of claim 23, wherein the substrate comprises a circuit connected to each of the plurality of jack contacts mounted on the substrate, and the communications jack further comprises:

a wire contact connected to each of the circuits, each of the circuits connecting one of the jack contacts to one of the wire contacts, each of the wire contacts being connectable to an external wire;

a body portion having an opening in communication with the receptacle, the opening being configured for the communication plug to pass therethrough to enter the receptacle;

a terminal block couplable to the body portion with the substrate positioned therebetween, the receptacle being at least partially defined by the body housing and at least partially defined by the substrate, the plurality of jack contacts extending outwardly from the substrate into the receptacle, the spring members of the spring assembly extending outwardly from the substrate into the receptacle, and the wire contacts extending outwardly from the substrate into the terminal block.

25. A spring assembly for use in a communications jack comprising a plurality of jack contacts, the jack being configured to receive a communications plug having a plug contact corresponding to each of the plurality of jack contacts, each of the plurality of jack contacts being electrically connected to a corresponding one of the plug contacts when the communications plug is received by the communications jack, the spring assembly comprising:

a corresponding conductive spring member for each of the plurality of jack contacts, each of the conductive spring members biasing the corresponding jack contact against the corresponding plug contact, selected ones of the conductive spring members being electrically connected to their corresponding jack contacts and comprising a capacitor plate, the capacitor plates of the selected ones of the conductive spring members being arranged to form at least one capacitor.

* * * * *